US006611413B2

(12) United States Patent
Takeuchi et al.

(10) Patent No.: US 6,611,413 B2
(45) Date of Patent: Aug. 26, 2003

(54) SWITCHING APPARATUS

(75) Inventors: Toshie Takeuchi, Tokyo (JP); Toyomi Ooshige, Tokyo (JP); Hiroyuki Sasao, Tokyo (JP); Hiroyuki Akita, Tokyo (JP); Yukimori Kishida, Tokyo (JP); Mitsuru Tsukima, Tokyo (JP); Kenichi Koyama, Tokyo (JP); Toshiyuki Yoshizawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 121 days.

(21) Appl. No.: 09/862,463

(22) Filed: May 23, 2001

(65) Prior Publication Data

US 2002/0044403 A1 Apr. 18, 2002

(30) Foreign Application Priority Data

Oct. 16, 2000 (JP) ..... 2000-315185

(51) Int. Cl.[7] ..... H01H 47/00
(52) U.S. Cl. ..... 361/139; 361/152
(58) Field of Search ..... 361/139, 152, 361/153, 154, 160; 335/147, 148, 223; 218/141

(56) References Cited

U.S. PATENT DOCUMENTS

| | | | | | |
|---|---|---|---|---|---|
| 4,086,645 | A | | 4/1978 | Gorman et al. | 361/155 |
| 4,250,360 | A | * | 2/1981 | Svensson | 200/82 C |
| 5,680,084 | A | * | 10/1997 | Kishi et al. | 335/151 |
| 6,046,423 | A | | 4/2000 | Kishida et al. | 218/154 |
| 6,295,191 | B1 | * | 9/2001 | Kishida et al. | 361/139 |
| 6,353,376 | B1 | * | 3/2002 | Takeuchi et al. | 335/147 |
| 6,534,738 | B2 | * | 3/2003 | Makino | 218/118 |

FOREIGN PATENT DOCUMENTS

DE 39 10010 10/1989

* cited by examiner

*Primary Examiner*—Adolf D. Berhane
(74) *Attorney, Agent, or Firm*—Leydig, Voit & Mayer, Ltd.

(57) ABSTRACT

A switching device includes a pair of fixed coils and a pair of movable coils, with one pair being disposed between the other pair. Two of the coils may be connected back to back on opposite sides of a support plate to increase the stiffness of the coils and reduce damage due to impact between the fixed and movable coils. The coils include two sets of coils, each set including one of the fixed coils and one of the movable coils. The coil sets can be driven simultaneously or at different times to effect contact opening and closing.

8 Claims, 25 Drawing Sheets

SWITCHING APPARATUS

This application is based on Application No. 2000-315185, filed in Japan on Oct. 16, 2000, the contents of which are hereby incorporated by reference.

BACKGROUND OF THE INVENTION

1. Field of the Invention

This invention relates to a switching apparatus which employs the interaction of magnetic fields produced by opposing coils having currents flowing through them to generate a drive force which can open and close electrodes to make or interrupt a circuit.

2. Description of the Related Art

FIGS. 24A and 24B are diagrams showing the structure of a switching apparatus utilizing electromagnetic repulsive force. The illustrated switching apparatus includes a switch portion 3 which carries out opening and closing of an electric circuit, a movable shaft 5 which transmits a drive force which opens and closes the switch portion 3, an operating mechanism 9 which exerts a drive force on the movable shaft 5 to open and close the switch portion 3, and a control circuit 30 which controls the operating mechanism 9.

The switch portion 3 includes a fixed electrode 1 which is secured to a stationary support plate 16 and a movable electrode 2 which is disposed opposite the fixed electrode 1. In order to obtain good arc extinguishing properties for the switch portion 3, the electrodes 1 and 2 are housed in an evacuated chamber 4. A first terminal 14 is connected to the fixed electrode 1 and a second terminal 15 is connected to the movable electrode 2. The switch portion 3 can be connected to an external electric circuit through these terminals 14 and 15.

The movable shaft 5 includes a live portion 6 connected to the movable electrode 2 and a non-live portion 7 connected to the operating mechanism 9. The live portion 6 and the non-live portion 7 are connected to each other by an electrically insulating rod 8 which prevents current from flowing from the switch portion 3 to the operating mechanism 9.

The operating mechanism 9 includes a contact opening fixed coil 11 which is secured to a stationary support plate 17, a contact closing coil 12 which is secured to another stationary support plate 18, a movable coil 10 which is secured to movable shaft 5 and which is disposed between contact opening fixed coil 11 and contact closing fixed coil 12, and a bidirectional biasing spring 13 which is secured to a spring support plate 19 and to non-live portion 7 of the movable shaft 5. The movable shaft 5 can freely pass through support plate 17 and support plate 18, so the movable coil 10 can freely reciprocate between contacting opening fixed coil 11 and contact closing fixed coil 12. The biasing spring 19 is a non-linear spring which exerts a biasing force which changes in direction depending on the position of the movable shaft 5. Namely, when the movable shaft 5 is in the raised position shown in FIG. 24A, the biasing spring 19 exerts an upwards biasing force on the movable shaft 5 to maintain the contacts of the switch portion 3 in a closed state, and when the movable shaft 5 is in the lowered position shown in FIG. 24B, the biasing spring 19 exerts a downwards biasing force on the movable shaft 5 to maintain the contacts of the switch portion 3 in an open state. A biasing spring of this type is disclosed in Japanese Patent Laid-Open No. 2000-048683, laid-open on Feb. 18, 2000, for example.

FIG. 25 is a circuit diagram of one example of the control circuit 30 for the operating mechanism 9. The control circuit 30 includes a contact opening electric power storage device 31*a*, such as a capacitor, which stores electrical energy for contact opening, a contact closing electric power storage device 31*b*, such as another capacitor, which stores electrical energy for contact closing, a contact opening switch 32*a* comprising a semiconductor element, such as a thyristor, for contact opening, a contact closing switch 32*b* also comprising a semiconductor element, such as a thyristor, for contact closing, an opening diode 33*a* connected between contact opening fixed coil 11 and movable coil 10, a contact closing diode 33*b* connected between contact closing fixed coil 12 and movable coil 10, and diodes D1, D2, D3, which are connected in parallel with contact opening fixed coil 11, movable coil 10, and contact closing fixed coil 12, respectively, and which release the electromagnetic energy which is stored in the corresponding coils. During use of the switching apparatus, electric power is supplied to the electric power storage devices 31*a* and 31*b* by a DC power supply 34 connected as shown in the figure.

Next, contact opening operation will be explained. When the switching apparatus is in the closed contact state shown in FIG. 24A, if the contact opening switch 32*a* of FIG. 25 is turned on, a pulse current flows from the contact opening electric power storage device 31*a* through the contact opening switch 32*a* to the contact opening fixed coil 11, and a magnetic field is generated. At the same time, a pulse current flows through the contact opening diode 33*a* to the movable coil 10, and a magnetic field having the opposite direction from the magnetic field generated in the contact opening fixed coil 11 is generated in the movable coil 10. Due to the interaction of the magnetic fields generated in the two coils 10 and 11, a repelling force is generated, the movable coil 10 is pushed downwards in the figure, the movable shaft 5 which is secured to the movable coil 10 is also pushed downwards, and the contacts of the switch portion 3 are opened.

When the pulse current is no longer supplied, the electromagnetic energy which is stored in the contact opening fixed coil 11 and the movable coil 10 passes through diodes D1 and D2, respectively, and gradually decreases by circulating in coils 11 and 10.

At this time, due to diode 33*b*, the pulse current does not flow into the contact opening fixed coil 12, so a magnetic field is not generated by this coil 12.

Next, contact closing operation will be explained. When the switching apparatus is in the open contact state shown in FIG. 24B, if contact closing switch 32*b* of FIG. 25 is turned on, a pulse current flows from contact closing electric power storage device 31*b* through contact closing switch 32*b* to contact closing fixed coil 12, and a magnetic field is generated by this coil 12. At the same time, a pulse current also flows through contact closing diode 33*b* to movable coil 10, and a magnetic field having the opposite direction from the magnetic field generated by contact closing fixed coil 12 is generated by movable coil 10. Due to the interaction of the magnetic fields generated between these two coils, a repulsive force is generated, the movable coil 10 is pushed upwards in the figure, the movable shaft 5 secured to the movable coil 10 in FIG. 24B is also pushed upwards, and the contacts of switch portion 3 are closed.

Due to an action similar to the contact opening operation, when a pulse current is no longer supplied, the electromagnetic energy stored in the contact closing fixed coil 12 and movable coil 10 passes through diodes D3 and D2, respectively, and circulates in coil 11 and 10, respectively, and gradually decreases.

The switching device of FIGS. 24A and 24B carries out switching by electromagnetic repulsive action which repulses coils from each other, so the speed of operation is fast. However, due to the impact between coils caused by this high speed operation, a large impact force is generated by the movable coil and the fixed coils, and this device has the problem that the securing portions of the coils may be damaged.

In addition, in the device of FIGS. 24A and 24B, a single movable coil is used to perform both contact opening and contact closing, and there is a limit on the speed of operation when a driving force is provided only by an electromagnetic repulsive force, so the illustrated device has the problems that it is difficult for it to cope with demands for increased speed and control modifications.

SUMMARY OF THE INVENTION

The present invention was made in order to solve problems like those described above. An object of the present invention is to provide a switching apparatus which prevents damage to coils, which can increase the speed and responsiveness of operation, and which has good stability and highly reliable control.

According to one form of the present invention, a switching apparatus includes a switch portion having a fixed electrode and a movable electrode which is movable with respect to the fixed electrode between an open and a closed position to open and close the switch portion. A movable shaft extends from the movable electrode and is movable by an operating mechanism having a pair of fixed coils and a pair of movable coils. The movable coils are operatively connected to the movable shaft for translating the movable shaft in its axial direction. One of the pairs of coils is disposed between the other pair of coils. A controller controls a supply of current to the coils of the operating mechanism.

The operating mechanism may include a support plate connected to the movable shaft, with the movable coils being disposed back to back on opposite sides of the support plate and being supported by the support plate between the fixed coils.

The operating mechanism may also include an outer frame connected to the movable shaft and a support plate supported by the outer frame, with the movable coils being disposed back to back on opposite sides of the support plate and being supported by the support plate between the fixed coils.

In another form of the present invention, the operating mechanism may include a support plate, with the fixed coils being disposed back to back on opposite sides of the support plate and being supported by the support plate between the movable coils, and with the movable coils being connected to the movable shaft.

The coils of the operating mechanism may comprise a first set of coils comprising one of the fixed coils and one of the movable coils, and a second set of coils comprising the other of the fixed coils and the other of the movable coils. In one form of the present invention, the controller supplies current to one of the sets of coils but not to the other set of coils to repel the two coils of the one set from each other to open the switch portion and supplies current to the other set of coils but not to the one set of coils to repel the two coils of the other set from each other to close the switch portion.

In another form of the present invention, during opening or closing of the switch portion, the controller supplies current to one of the sets of coils to repel the two coils of the one set from each other and simultaneously supplies current to the other set of coils to attract the two coils of the other set to each other.

In yet another form of the present invention, during opening or closing of the switch portion, the controller supplies current to one of the sets of coils to repel the two coils of the one set from each other and subsequently supplies current to the other set of coils to attract the two coils of the other set to each other.

In still another form of the present invention, the controller supplies current to a set of coils prior to contact between the two coils of the set of coils to repel the two coils from each other and generate a braking force.

DESCRIPTION OF PREFERRED EMBODIMENTS

Figure 1:
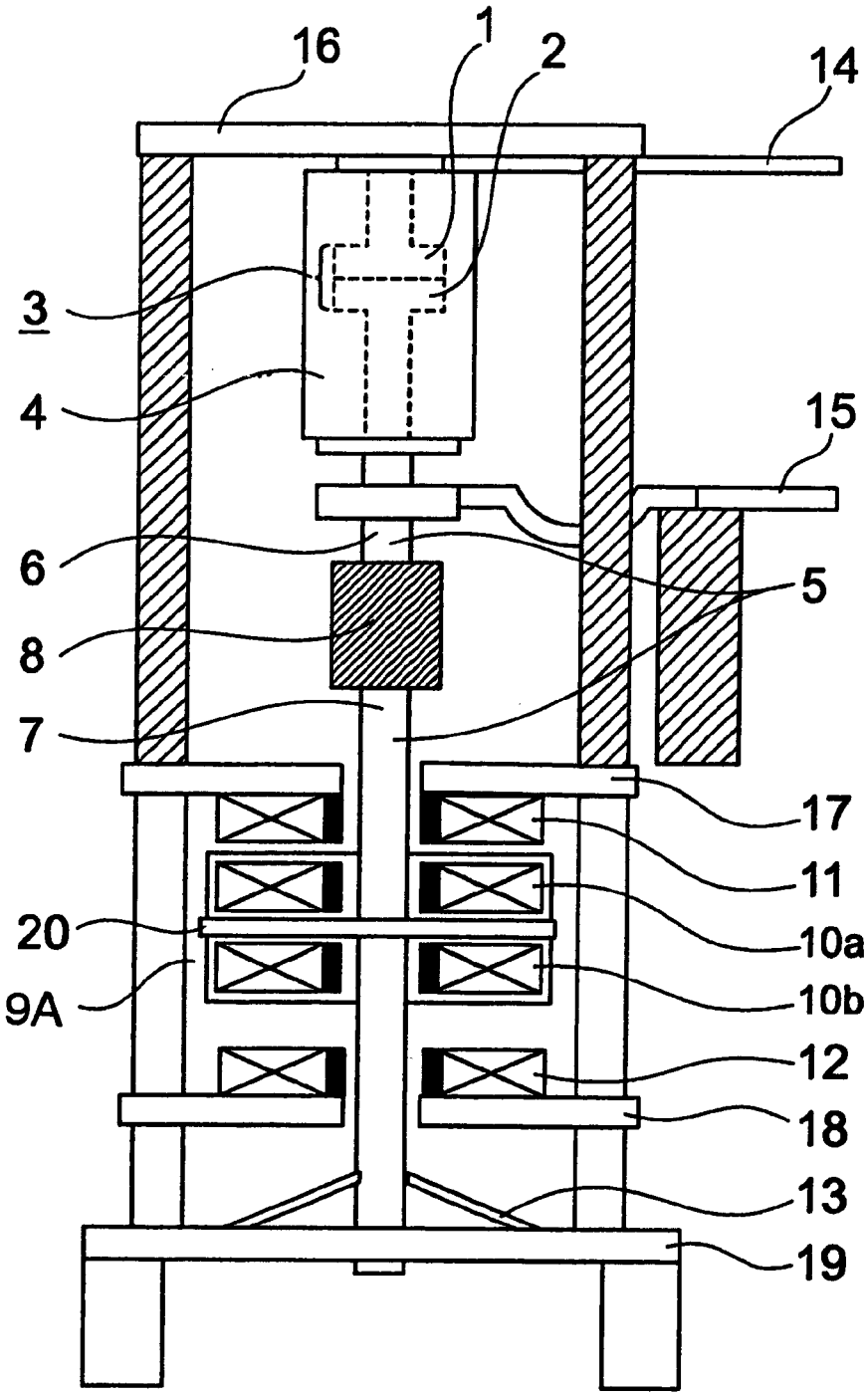
FIG. 1 is a partially cross-sectional schematic elevation of a first embodiment of a switching apparatus according to the present invention.
Figure 24B:
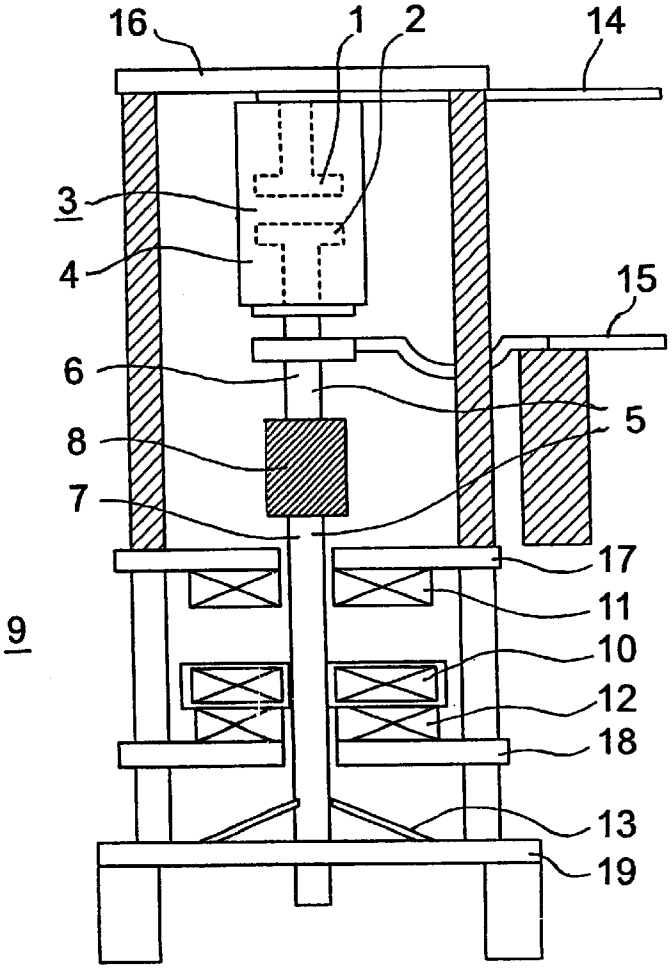
FIGS. 24A and 24B are schematic elevations of a switching apparatus utilizing repulsive force in an open contact state and a closed contact state, respectively.
Figure 24A:
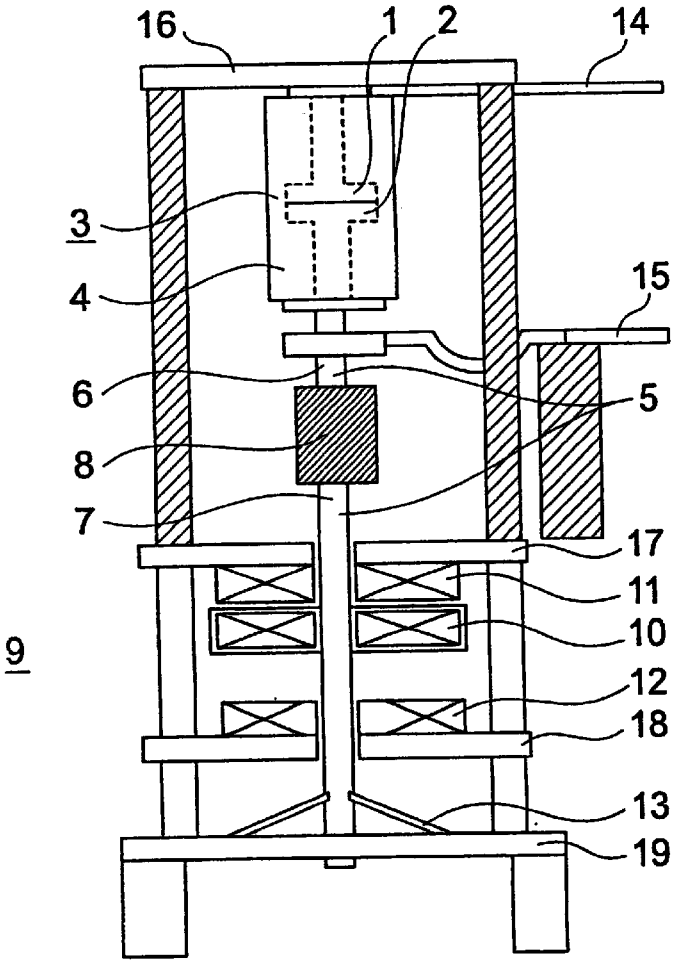
Figure 25:
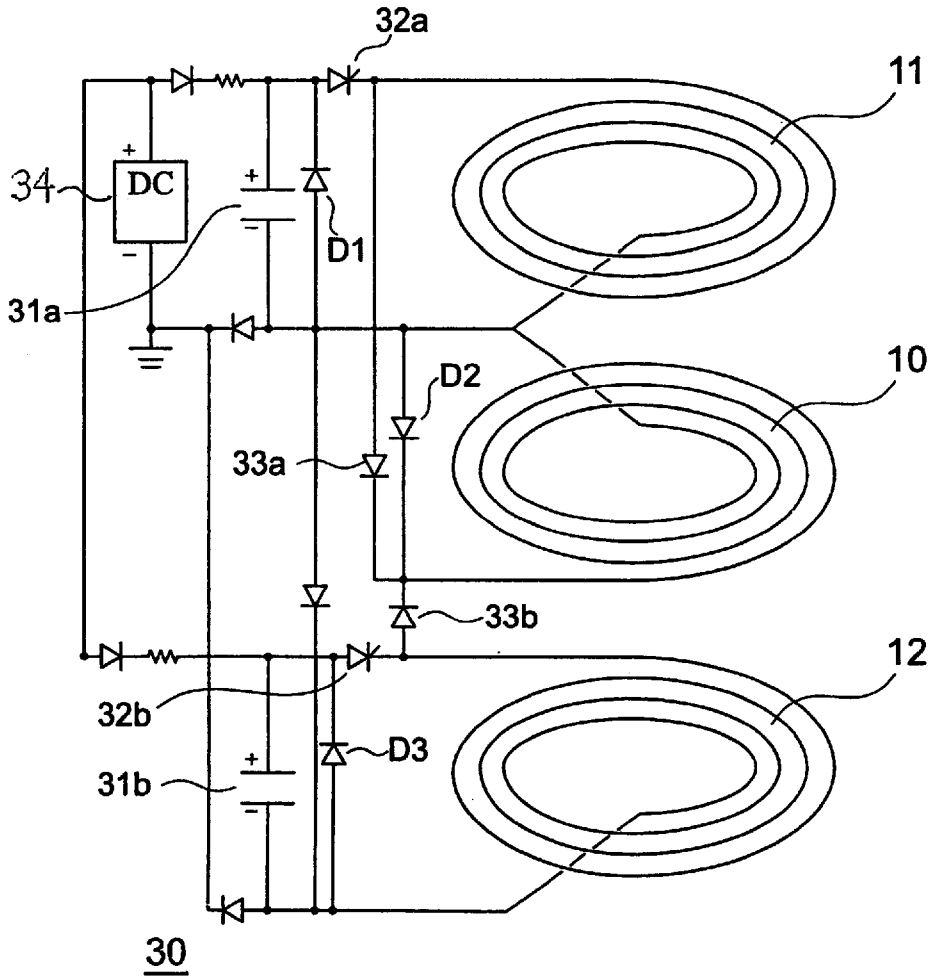
FIG. 25 is a circuit diagram of a control circuit of the switching apparatus of FIGS. 24A and 24B.

FIG. 1 is a schematic elevation of a first embodiment of a switching apparatus according to the present invention. Like the apparatus shown in FIGS. 24A and 24B, this embodiment includes a switch portion 3 having a fixed electrode 1 and a movable electrode 2 housed inside an evacuated chamber 4. The fixed electrode 1 is secured to a support plate 16 which forms an outer plate of the switching apparatus. The movable electrode 2 opposes the fixed electrode 1 and can reciprocate with respect to the fixed electrode 1 between an open and a closed position. The fixed electrode 1 and the movable electrode 2 are respectively connected to a first terminal 14 and a second terminal 15 by which the switch portion 3 can be connected to an electric circuit. A movable shaft 5 having a live portion 6 and a non-live portion 7 connected to each other by an insulating rod 8 is connected to the movable electrode 2 and an operating mechanism 9A for opening and closing the switch portion 3. A support plate 20 perpendicular to the axis of the movable shaft 5 is secured to the movable shaft 5. The operating mechanism 9A includes a pair of movable coils 10*a* and 10*b* and a pair of fixed coils 11 and 12, with the movable coils 10*a* and 10*b* being disposed back to back between the fixed coils 11 and 12. Contact opening movable coil 10*a* and contact closing movable coil 10*b* are disposed on opposite sides of the support plate 20 and are secured thereto. The movable coils 10*a* and 10*b* are also secured to the movable shaft 5 to increase their stiffness. The contact opening fixed coil 11 is secured to a stationary support plate 17 opposing the contact opening movable coil 10*a*. The contact opening fixed coil 11 and the contact opening movable coil 10*a* are sufficiently close to each other that when these two coils conduct, the magnetic fields generated by the two coils can interact. Contact closing fixed coil 12 is secured to a stationary support plate 18 opposing contact closing movable coil 10*b* and sufficiently close to coil 10*b* so that magnetic fields generated by the two coils 10*b* and 12 when they conduct can interact. Movable shaft 5 is connected to a bidirectional biasing spring 13 in the same manner as in FIG. 24A. The biasing spring 13 is secured to a stationary support plate 19.

Figure 2:
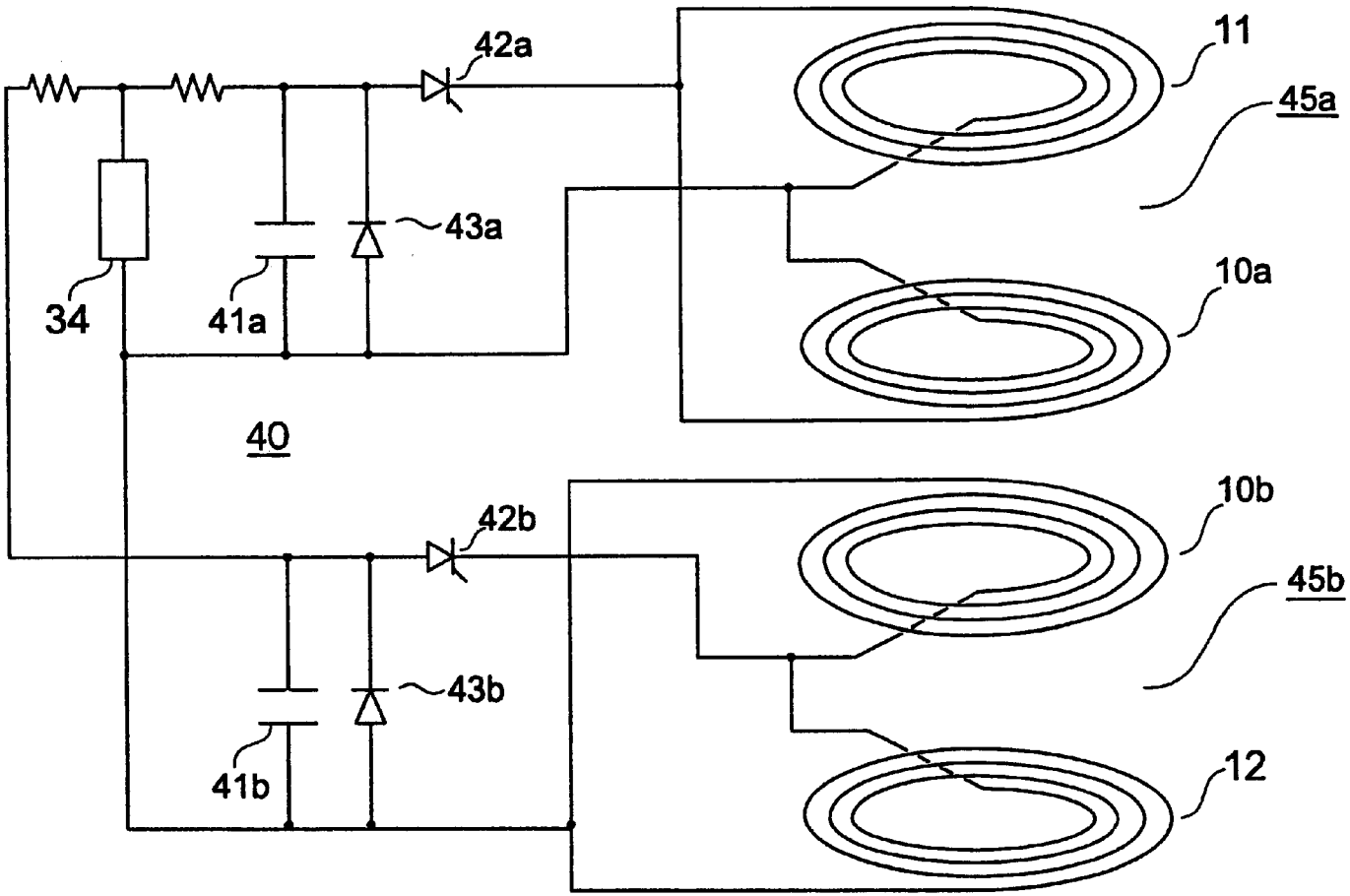
FIG. 2 is a circuit diagram of a control circuit of the embodiment of FIG. 1.

FIG. 2 is a circuit diagram of one example of a control circuit for controlling the operating mechanism 9A of FIG. 1. The control circuit 40 includes a contact opening electric power storage device 41*a*, such as a capacitor, which stores electrical energy for contact opening, a contact closing electric power storage device 41*b*, such as another capacitor, which stores electrical energy for contact closing, a contact opening switch 42*a* comprising a semiconductor element, such as a thyristor, for contact opening, a contact closing switch 42*b* also comprising a semiconductor element, such as a thyristor, for contact closing, and diodes 43*a* and 43*b* connected in parallel with contact opening fixed coil 11, movable coils 10*a* and 10*b*, and contact closing fixed coil 12 for releasing electromagnetic energy stored in these coils. During use of the switching apparatus, electric power is supplied to the electric power storage devices 41*a* and 41*b* by a DC power supply 34 connected as shown in the figure.

As illustrated in FIG. 2, the coils of the operating mechanism 9A are arranged in two sets 45*a* and 45*b*, with set 45*a* including movable coil 10*a* and fixed coil 11, and with set 45*b* including movable coil 10*b* and fixed coil 12.

Figure 3B:
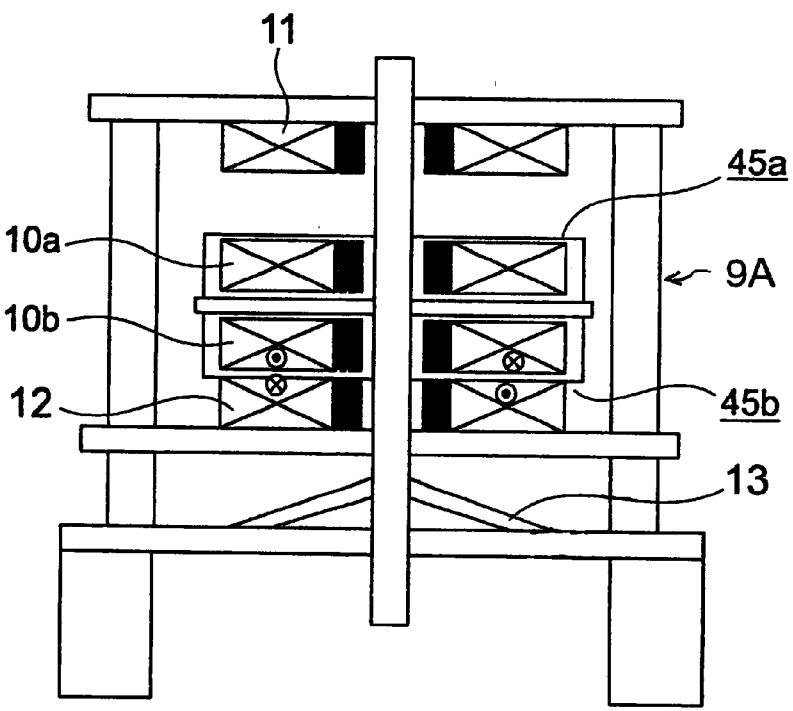
FIGS. 3A and 3B are schematic elevations of the operating mechanism of the embodiment of FIG. 1 in two different states.
Figure 3A:
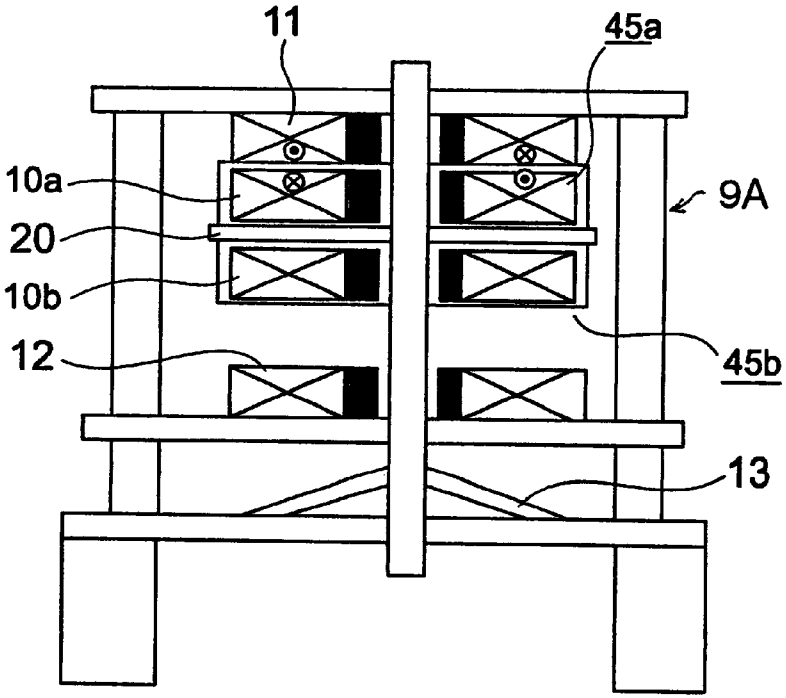
Figure 4A:
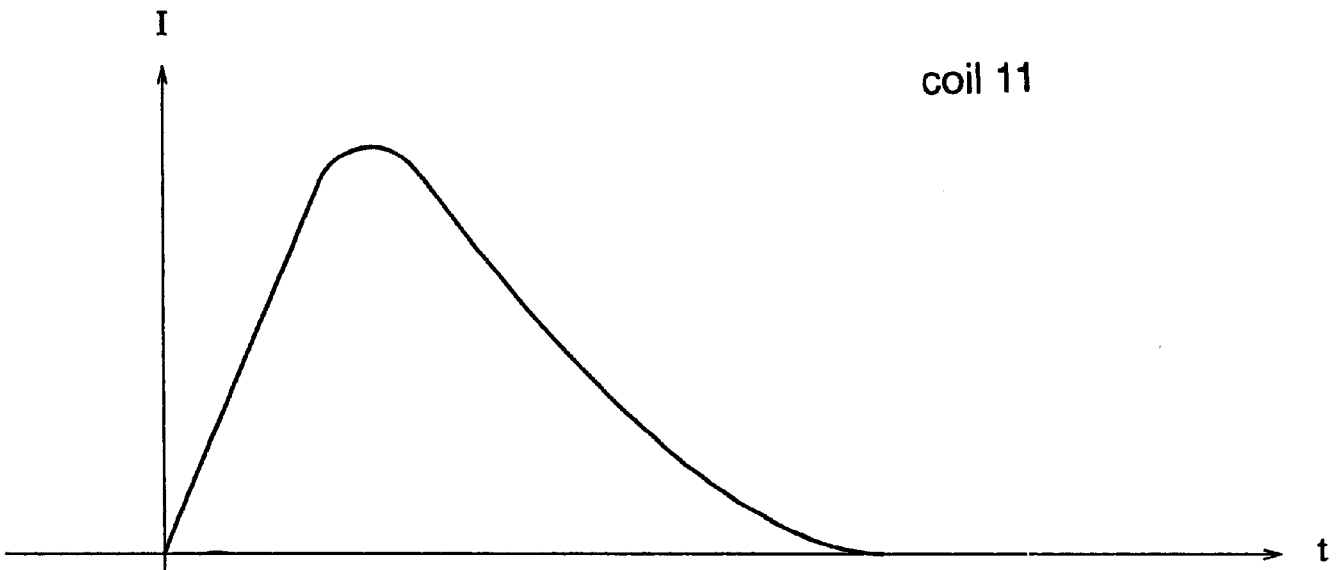
FIGS. 4A and 4B are graphs showing the pulse current flowing in two different coils of the embodiment of FIG. 1 during contact opening as a function of time.
Figure 4B:
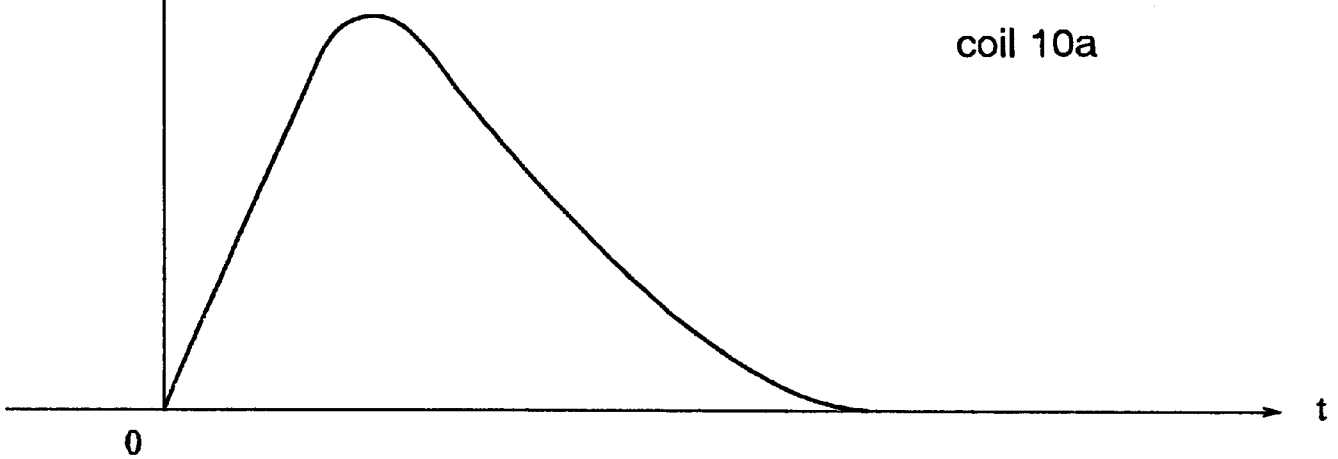

Next, the opening operation of this first embodiment of a switching apparatus will be explained while referring to FIGS. 3A, 4A, and 4B. FIG. 3A is a schematic elevation of the operating mechanism 9A of FIG. 1, showing the direction of current flowing in each coil during contact opening operation. FIGS. 4A and 4B show the changes over time in the currents flowing in coils 11 and 10*a*, respectively, during contact opening operation. When the switching apparatus is in the closed contact state shown in FIG. 3A, if contact opening switch 42*a* is turned on, as shown in FIG. 4A, a pulse current from contact opening electric power storage device 41*a* flows through contact opening switch 42*a* to contact opening fixed coil 11, and a magnetic field is generated by coil 11. At the same time, as shown in FIG. 4B, a pulse current flows through contact opening switch 42*a* to movable coil 10*a*, and a magnetic field having the opposite direction from the magnetic field generated by contact opening fixed coil 11 is generated by movable coil 10*a*. As a result, due to the interaction of the magnetic fields generated by these two coils 10*a* and 11, a repulsive force is generated, movable coil 10*a* is pushed downwards from the state shown in FIG. 3A to the state shown in FIG. 3B, the movable shaft 5 secured to support plate 20 is also pushed downwards, and the switch portion 3 is opened.

When the supply of the pulse current dies out, the electromagnetic energy which is stored in the contact opening fixed coil 11 and movable coil 10*a* passes through diode 43*a* and gradually decreases while circulating within coils 11 and 10*a*.

Figure 5A:
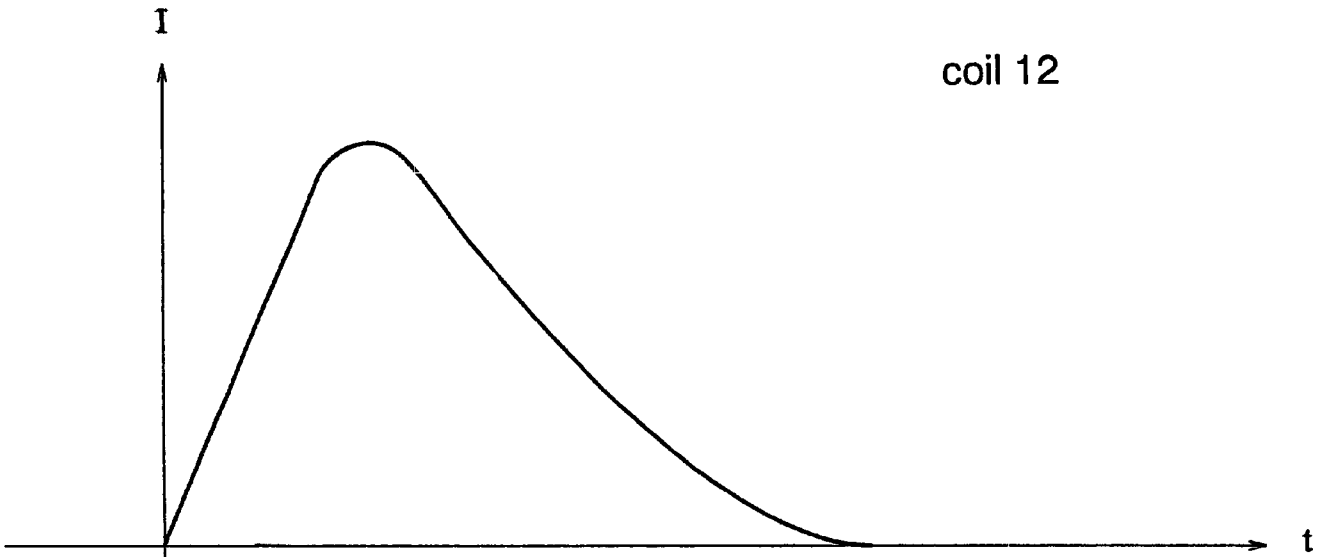
FIGS. 5A and 5B are graphs showing the pulse current flowing in two different coils of the embodiment of FIG. 1 during contact closing as a function of time.
Figure 5B:
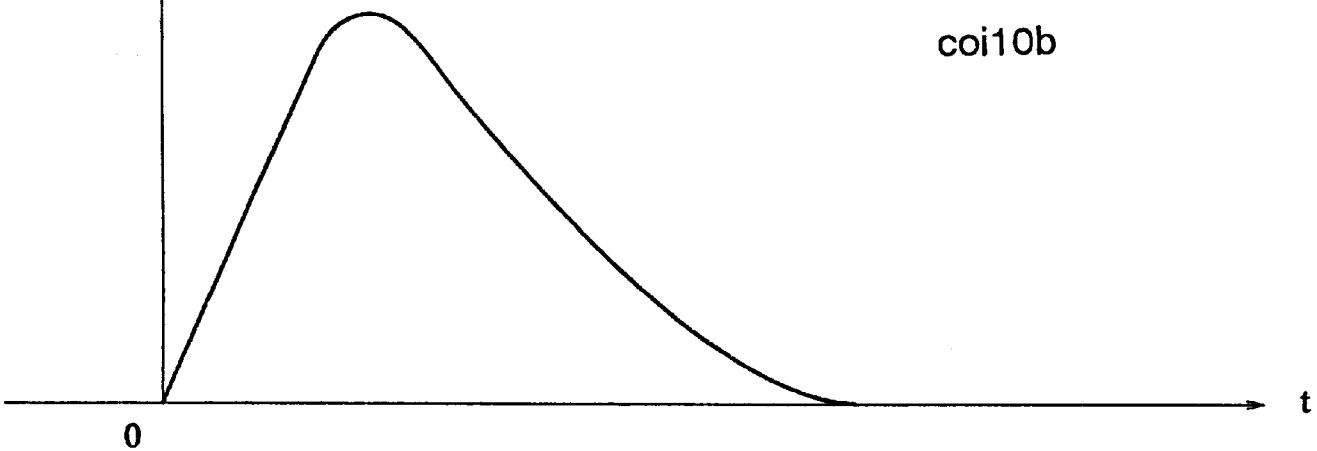

Next, contact closing operation will be explained while referring to FIGS. 3B, 5A, and 5B. FIG. 3B is a schematic elevation of the operating mechanism 9A of FIG. 1, showing the direction of current flowing in each coil during contact closing operation. FIGS. 5A and 5B show the changes over time in the currents flowing in coils 12 and 10*b*, respectively, during contact closing operation. When the switching apparatus is in the open contact state shown in FIG. 3B, if contact closing switch 42*b* is turned on, as shown in FIG. 5A, a pulse current flows from contact closing electric power storage device 41*b* through contact closing switch 42*b* to contact closing fixed coil 12, and a magnetic field is generated in fixed coil 12. At the same time, as shown in FIG. 5B, a pulse current also flows through contact closing switch 42*b* to movable coil 10*b*, and a magnetic field which is opposite in direction to the magnetic field generated by contact closing fixed coil 12 is generated by movable coil 10*b*. As a result, due to the interaction of the magnetic fields generated by coils 10*b* and 12, a repulsive force is generated between the two coils, movable coil 10*b* is pushed upwards from the state shown in FIG. 3B to the state shown in FIG. 3A, the movable shaft 5 secured to support plate 20 is also pushed upwards, and the switch portion 3 is closed.

As is the case during contact opening operation, when the supply of the pulse current dies out, the electromagnetic energy which is stored in contact closing fixed coil 12 and movable coil 10*b* passes through diode 43*b* and gradually decreases while circulating within coils 12 and 10*b*.

Accordingly, as movable coils 10*a* and 10*b* are strongly secured to support plate 20, they can withstand a large impact due to electromagnetic repulsion. As a different set of coils is used for contact opening operation and contact closing operation, if, for example, one coil is damaged, this can be coped with by another coil set. In addition, due to the support plate 20, the need to provide a reinforcing material between the opposing surfaces of a fixed coil and a movable coil is decreased, so the separation between the centers of a fixed coil and a movable coil can be decreased, and the electromagnetic repulsive force acting between opposing coils can be increased.

The control circuit 40 of this embodiment of the present invention is arranged such that only one of the two coil sets 45*a* and 45*b* is energized during contact opening operation and such that only the other coil set is energized during contact closing operation. Furthermore, both opening operation and closing operation are carried out using the electromagnetic repulsive force acting between a fixed coil and an opposing movable coil.

Figure 6:
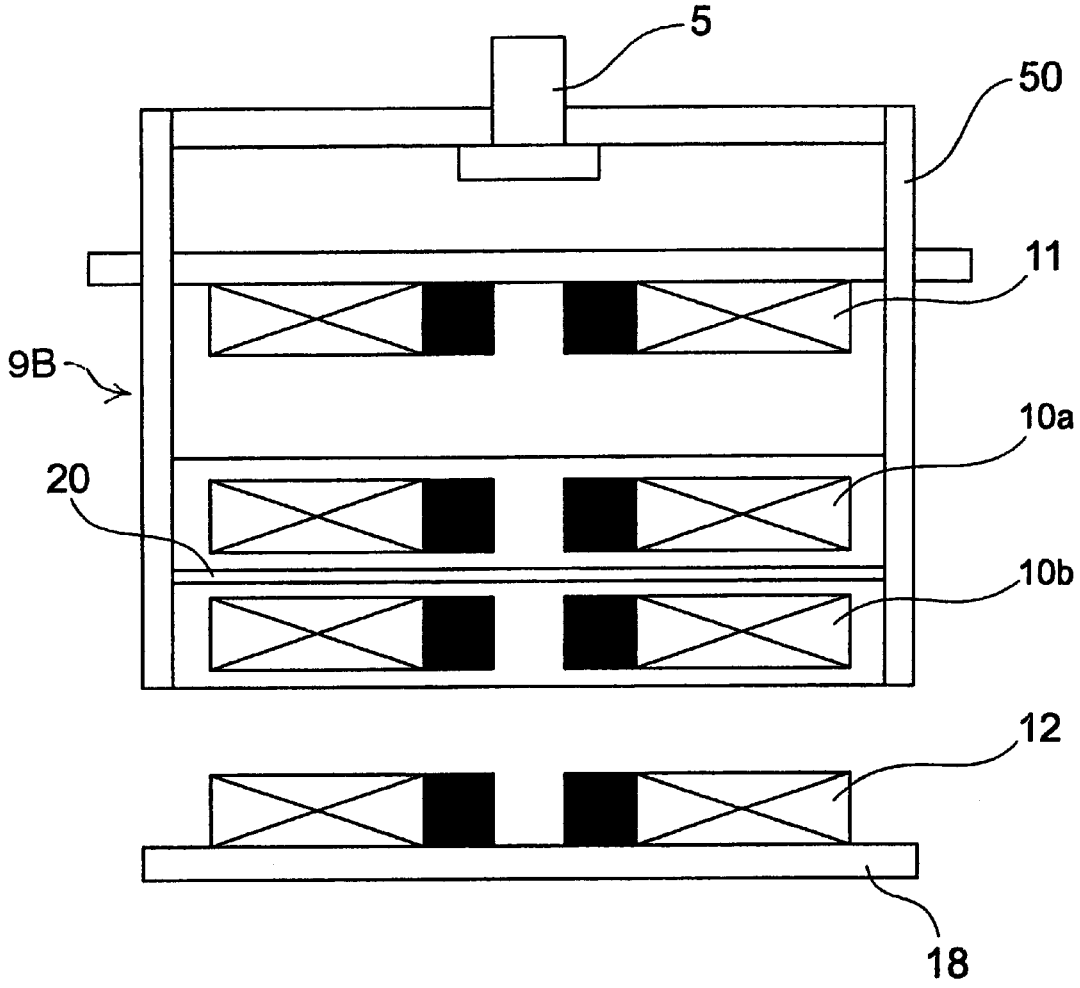
FIG. 6 is a schematic elevation of an operating mechanism of a second embodiment of a switching apparatus according to the present invention.

FIG. 6 is a schematic elevation of an operating mechanism 9B of a second embodiment of a switching apparatus according to the present invention. In FIG. 6, an outer frame 50 which is secured to contact opening movable coil 10*a*, to contact closing movable coil 10*b*, and to both side surfaces of a support plate 20 disposed between and secured to the movable coils 10*a* and 10*b* is secured to movable shaft 5 so as to cover contact opening fixed coil 11. Fixed coil 11 is secured to a stationary portion of the operating mechanism 9B. Movable coils 10*a* and 10*b* and outer frame 50 can reciprocate together with movable shaft 5 in the axial direction of the movable shaft 5 between contact opening fixed coil 11 and contact closing fixed coil 12, which is secured to a stationary support plate 18. The structure of this embodiment is otherwise the same as that of the embodiment of FIG. 1. The operating mechanism 9B is controlled by a control circuit having the same structure as control circuit 40 of FIG. 2, and contact opening and contact closing operation are carried out in the same manner as in the first embodiment.

In this embodiment, movable coils 10*a* and 10*b* are disposed back to back on opposite sides of support plate 20 between fixed coils 11 and 12 and are secured together with support plate 20 to outer frame 50, which is secured to movable shaft 5.

As a result of this structure, the same advantages as for the first embodiment are obtained, and as movable coils 10*a* and 10*b* are supported by the outer frame 50 along their outer periphery, stresses can be more uniformly distributed over the area of the movable coils 10*a* and 10*b*, giving them greater resistance to impact.

Figure 7:
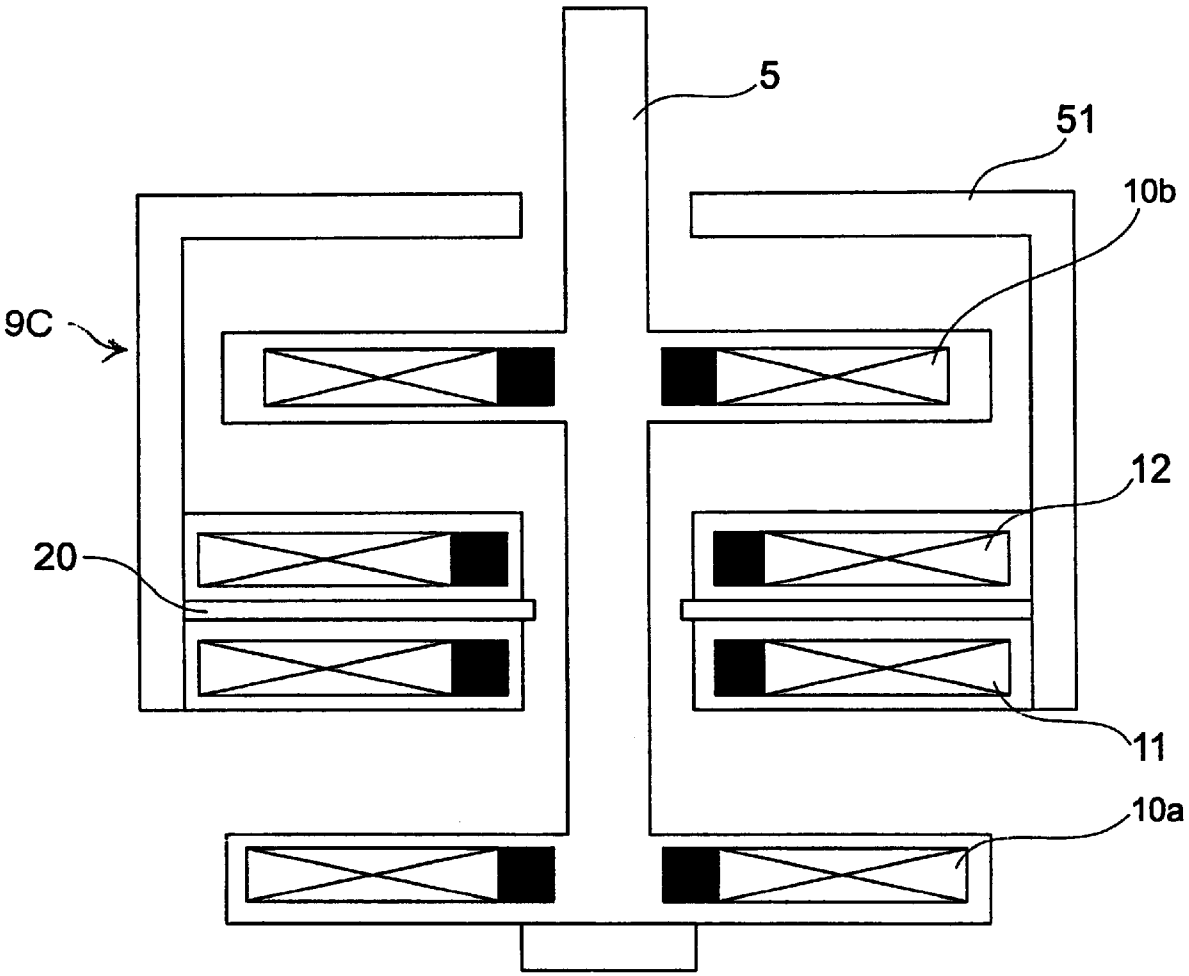
FIG. 7 is a schematic elevation of an operating mechanism of a third embodiment of a switching apparatus according to the present invention.

FIG. 7 is a schematic elevation of an operating mechanism 9C of a third embodiment of a switching apparatus according to the present invention. In FIG. 7, contact opening fixed coil 11 and contact closing fixed coil 12 are disposed back to back and secured to opposite sides of support plate 20. The fixed coils 11 and 12 and the support plate 20 are secured to an outer frame 51 of the switching apparatus. The fixed coils 11 and 12 are disposed between the movable coils 10*a* and 10*b*, with contact opening fixed coil 11 opposing contact opening movable coil 10*a* and with contact closing fixed coil 12 opposing contact closing movable coil 10*b*. The movable coils 10*a* and 10*b* are both secured to the movable shaft 5 so as to move together with the movable shaft 5 as it translates in its axial direction. The structure of the switching apparatus is otherwise the same as that of the embodiment of FIG. 1. The operating mechanism 9C is controlled by a control circuit having a structure like that of the control circuit 40 of FIG. 2, and contact opening and contact closing operation are carried out in the same manner as in the embodiment of FIG. 1.

In this embodiment, fixed coils 11 and 12 are connected back to back on opposite sides of support plate 20 and between movable coils 10*a* and 10*b*, which are secured to movable shaft 5.

With this structure, the same advantages as in the first embodiment are obtained. In addition, as fixed coils 11 and 12 are disposed between movable coils 10*a* and 10*b*, the sides of the movable coils 10*a* and 10*b* facing away from the fixed coils 11 and 12 are not contact by the movable coils, and since some space is present on these sides, they can be reinforced on these sides by a reinforcing material to increase their stiffness.

Figure 8B:
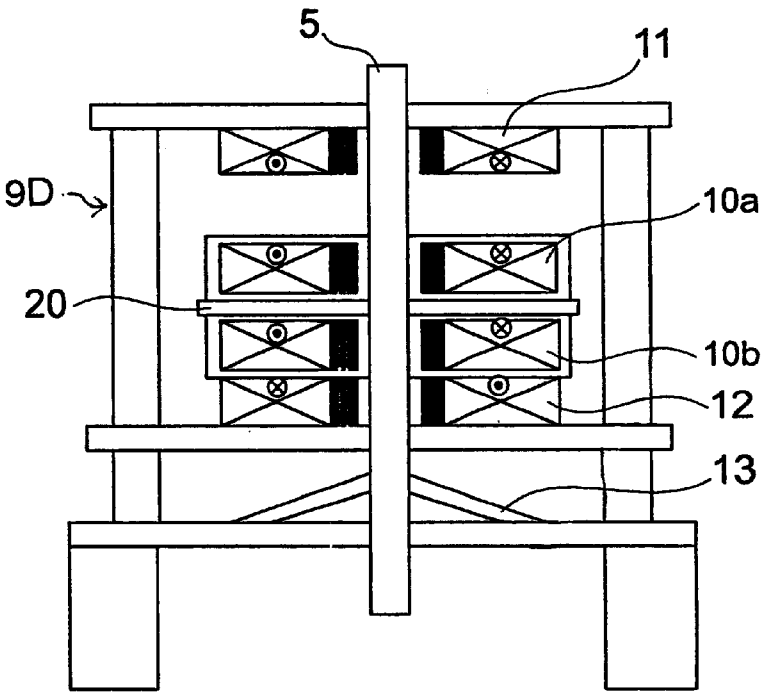
FIGS. 8A and 8B are schematic elevations of an operating mechanism of a fourth embodiment of a switching device according to the present invention and showing the direction of current flowing in each coil of the operating mechanism during contact opening and contact closing, respectively.
Figure 8A:
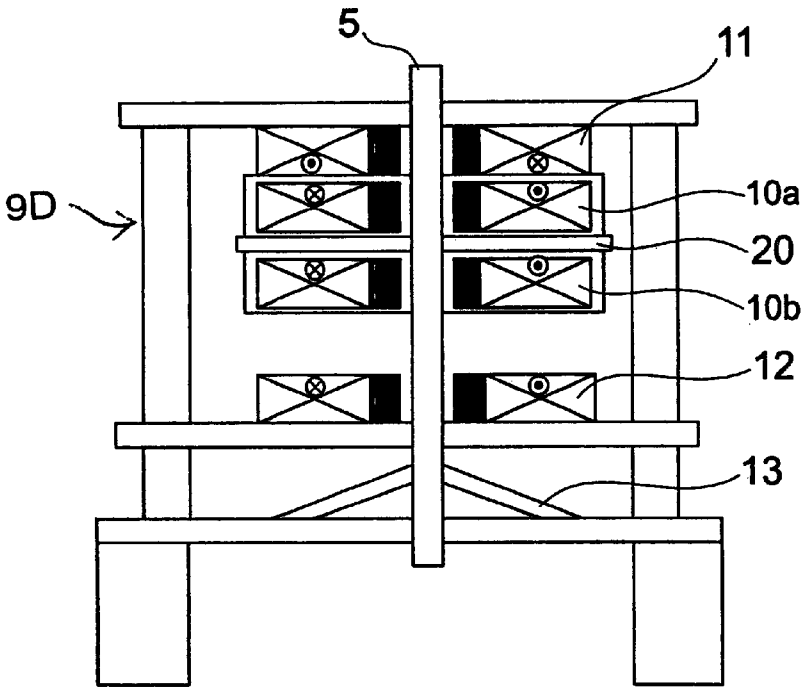
Figure 9:
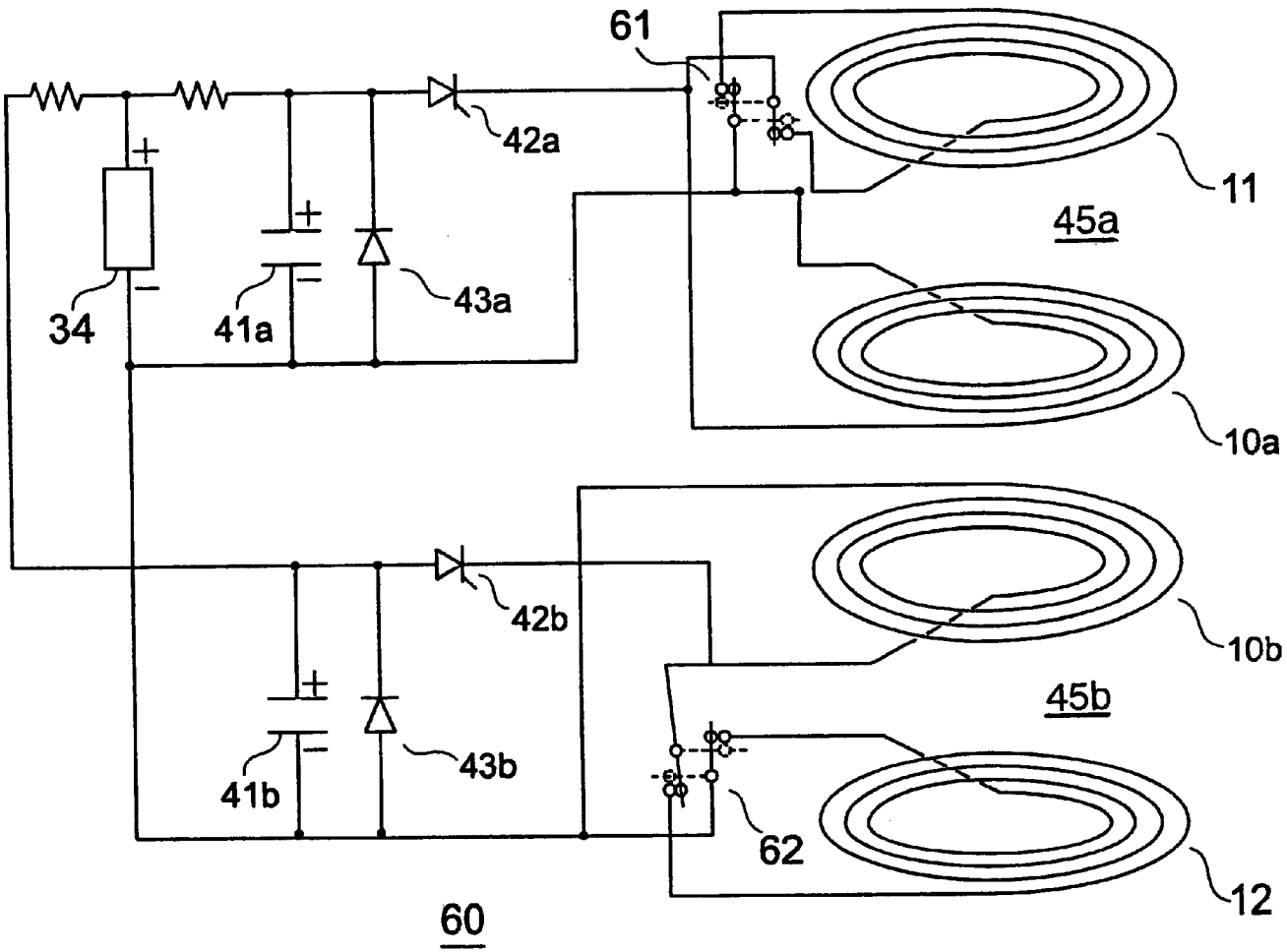
FIG. 9 is a circuit diagram of a control circuit of the embodiment of FIGS. 8A and 8B.
Figures 10A, 10B, 10C, 10D:
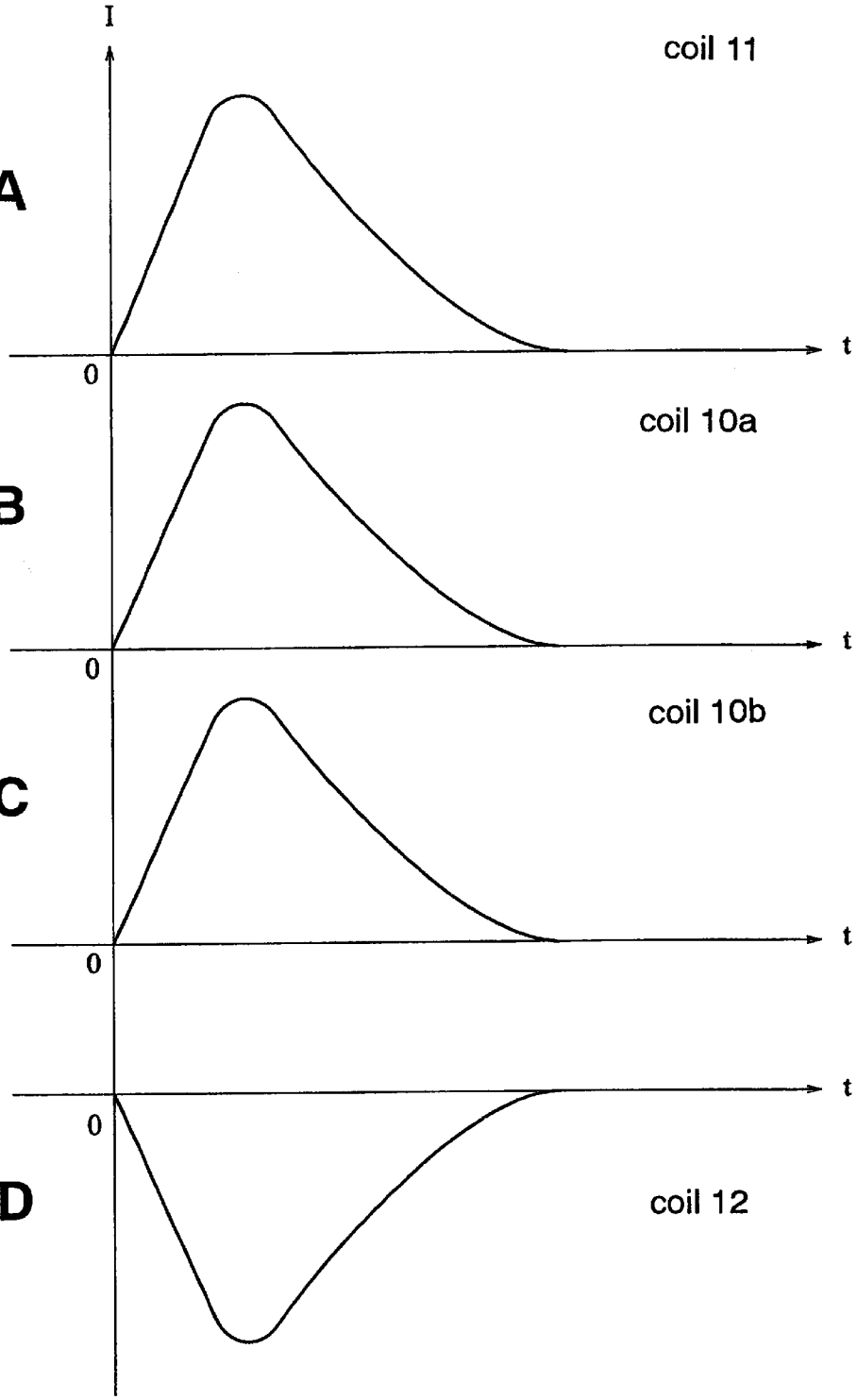
FIGS. 10A–10D are graphs showing changes with respect to time of a pulse current flowing in each coil of the embodiment of FIGS. 8A and 8B during contact opening.

FIGS. 8A and 8B are schematic elevations of an operating mechanism 9D of a fourth embodiment of a switching apparatus according to the present invention showing the direction of current flowing in each coil of the operating mechanism 9D during contact opening operation and contact closing operation, respectively. FIG. 9 is a circuit diagram of a control circuit 60 for the operating mechanism 9D. The operating mechanism 9D has the same structure as the operating mechanism 9A of FIG. 1, but the control circuit 60 for the operating mechanism 9D is constructed such that the direction of current flowing through certain coils can be reversed. As a result, opposing coils can be made to exert either a repulsive force or an attractive force on each other.

As shown in FIG. 9, changeover switches 61 and 62 are installed just before each fixed coil 11 and 12 for reversing the direction of current flow in the contact opening fixed coil 11 and the contact closing fixed coil 12 of FIGS. 8A and 8B. FIGS. 10A–10D are graphs showing the changes with time of the current flowing in each coil during contact opening operation of this embodiment.

In order to perform contact opening operation from a closed contact state of this embodiment of a switching apparatus, when the operating mechanism 9D is in the closed contact state shown in FIG. 8A, changeover switch 61 shown in FIG. 9 is set to the state shown by dashed lines, changeover switch 62 is set to the state shown by solid lines, and contact opening switch 42*a* and contact closing switch 42*b* are simultaneously turned on. As shown in FIGS.

10A–10D, this causes a pulse current to simultaneously flow in contact opening fixed coil 11, contact opening movable coil 10*a*, contact closing fixed coil 10*b*, and contact closing fixed coil 12. Contact opening fixed coil 11 and contact opening movable coil 10*a* together generate an electromagnetic repulsive force with respect to each other, while contact closing fixed coil 12 and contact closing movable coil 10*b* together generate an electromagnetic attractive force with respect to each other. Due to the electromagnetic repulsive force and the electromagnetic attractive force, movable coils 10*a* and 10*b* are moved downwards from the position shown in FIG. 8A to the position shown in FIG. 8B, the movable shaft 5 is moved downwards with movable coils 10*a* and 10*b*, and the contacts of switch portion 3 are opened.

In order to perform contact closing operation, when the operating mechanism 9D is in the open contact state shown in FIG. 8B, changeover switch 61 is switched to a state shown by solid lines, changeover switch 62 is switched to a state shown by dashed lines, and contact opening switch 42*a* and contact closing switch 42*b* are simultaneously turned on to cause a pulse current to simultaneously flow in all four coils 10*a*, 10*b*, 11, and 12. These currents cause contact closing fixed coil 12 and contact closing movable coil 10*b* to generate an electromagnetic repulsive force with respect to each other, while contact opening fixed coil 11 and contact opening movable coil 10*a* together generate an electromagnetic attractive force with respect to each other. As a result, the movable coils 10*a* and 10*b* and the movable shaft 5 are moved upwards from the position shown in FIG. 8B to the position shown in FIG. 8A, and the contacts of switch portion 3 are closed.

In this manner, in order to open or close the switch portion 3, the control circuit 60 of this embodiment supplies current to one set of coils so that an electromagnetic force acts in a direction so as to repel the fixed coil and the movable coil of the coil set from each other, and at the same time it supplies current to the other set of coils such that the fixed coil and the movable coil of the other coil set are attracted to each other, whereby switch portion 3 is opened and closed.

Accordingly, opening operation and closing operation are each performed not solely by an electromagnetic repulsive force but by an electromagnetic repulsive force in combination with an electromagnetic attractive force, so contact opening and closing operation can be performed rapidly and with certainty.

Figure 11:
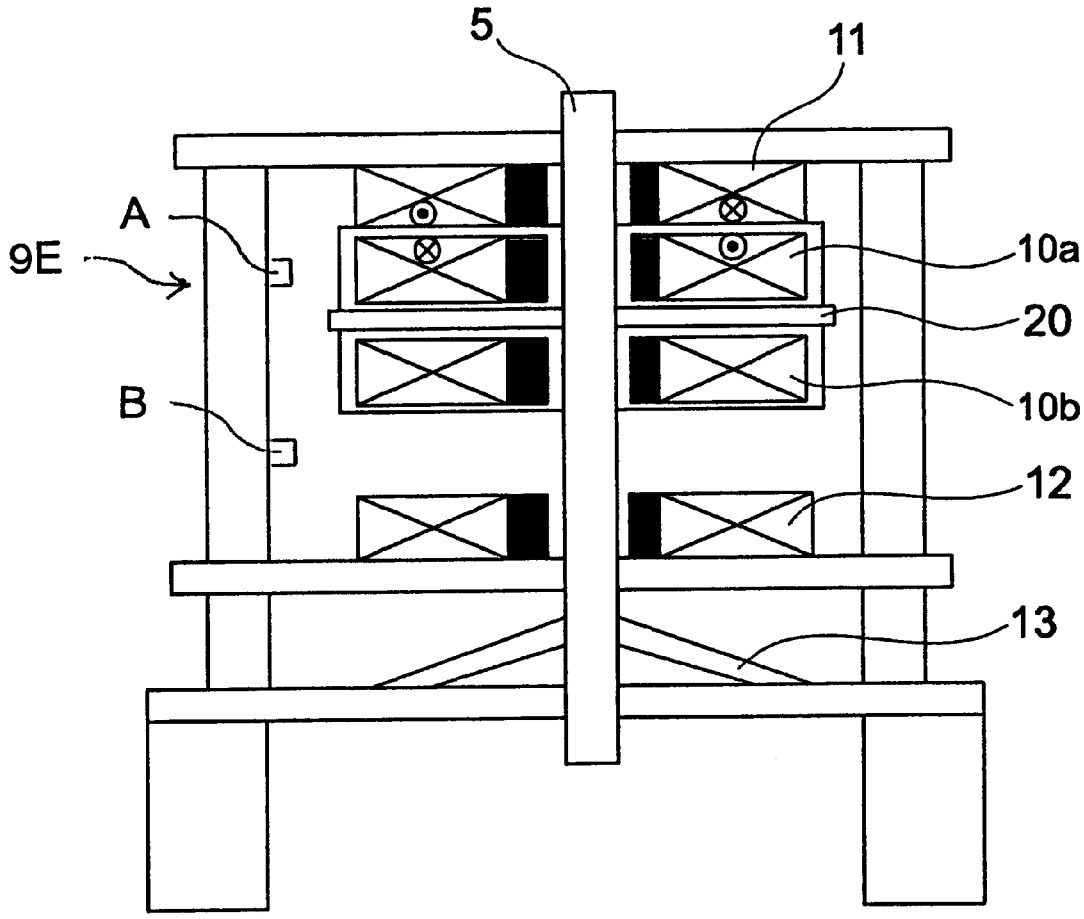
FIG. 11 is a schematic elevation of an operating mechanism of a fifth embodiment of a switching device according to the present invention showing the direction of current flowing in each coil of the operating mechanism at the start of contact opening.
Figure 12:
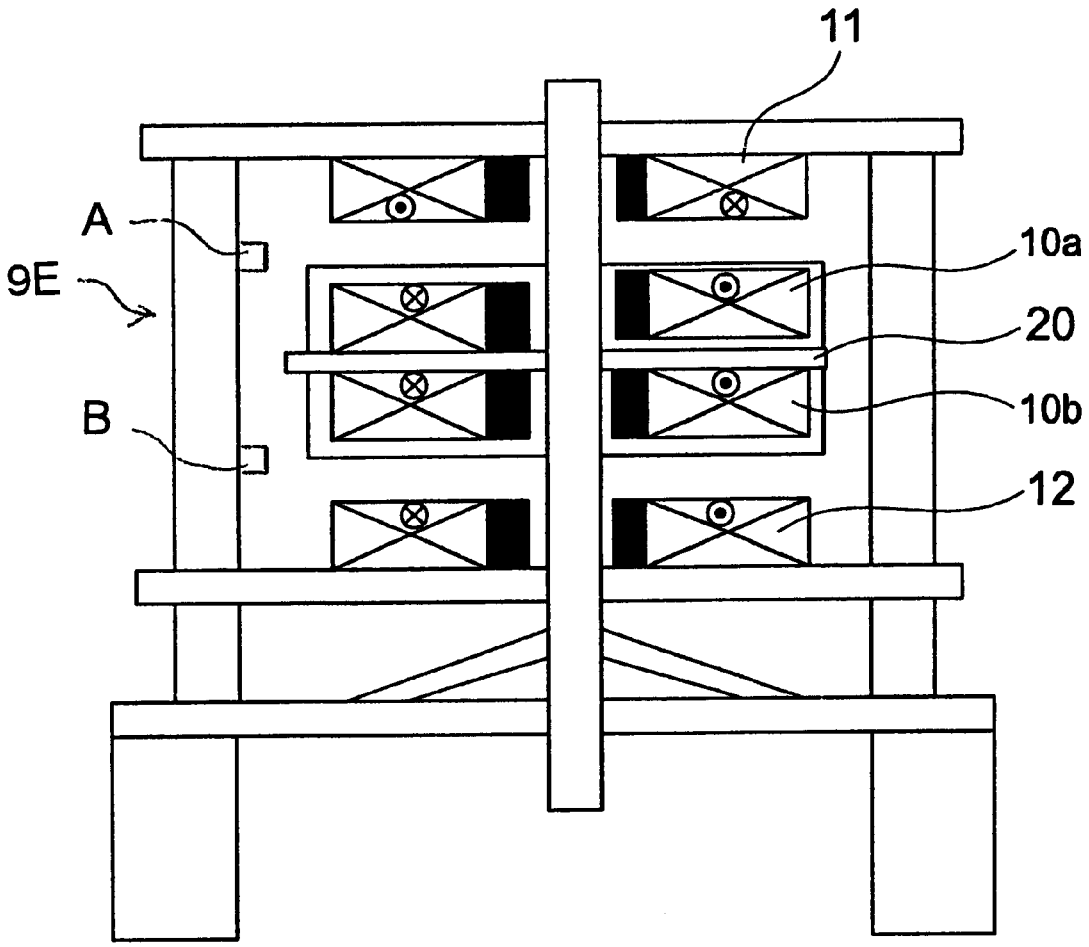
FIG. 12 is a schematic elevation of the operating mechanism of FIG. 11 showing the direction of current flow after the start of contact opening.
Figure 13:
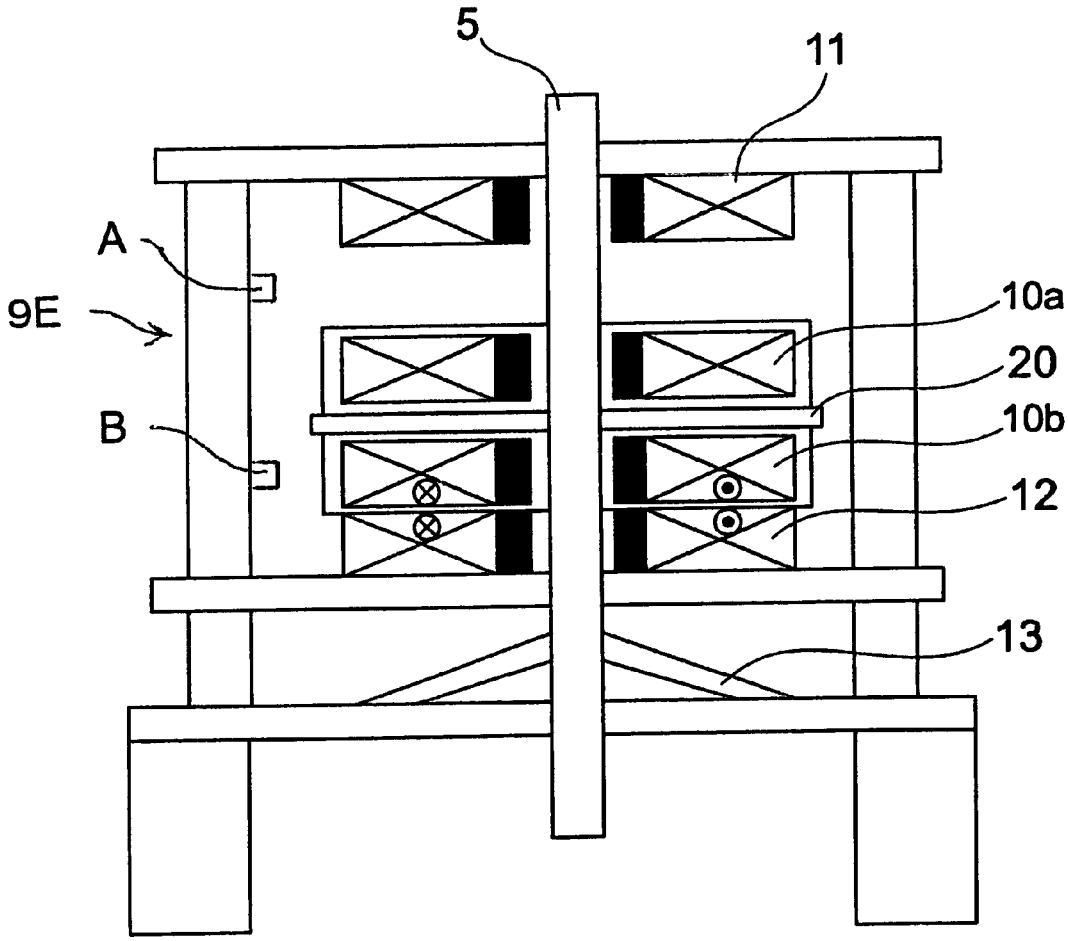
FIG. 13 is a schematic elevation of the operating mechanism of FIG. 11 showing the direction of current flow at the completion of contact opening.
Figures 14A, 14B, 14C, 14D:
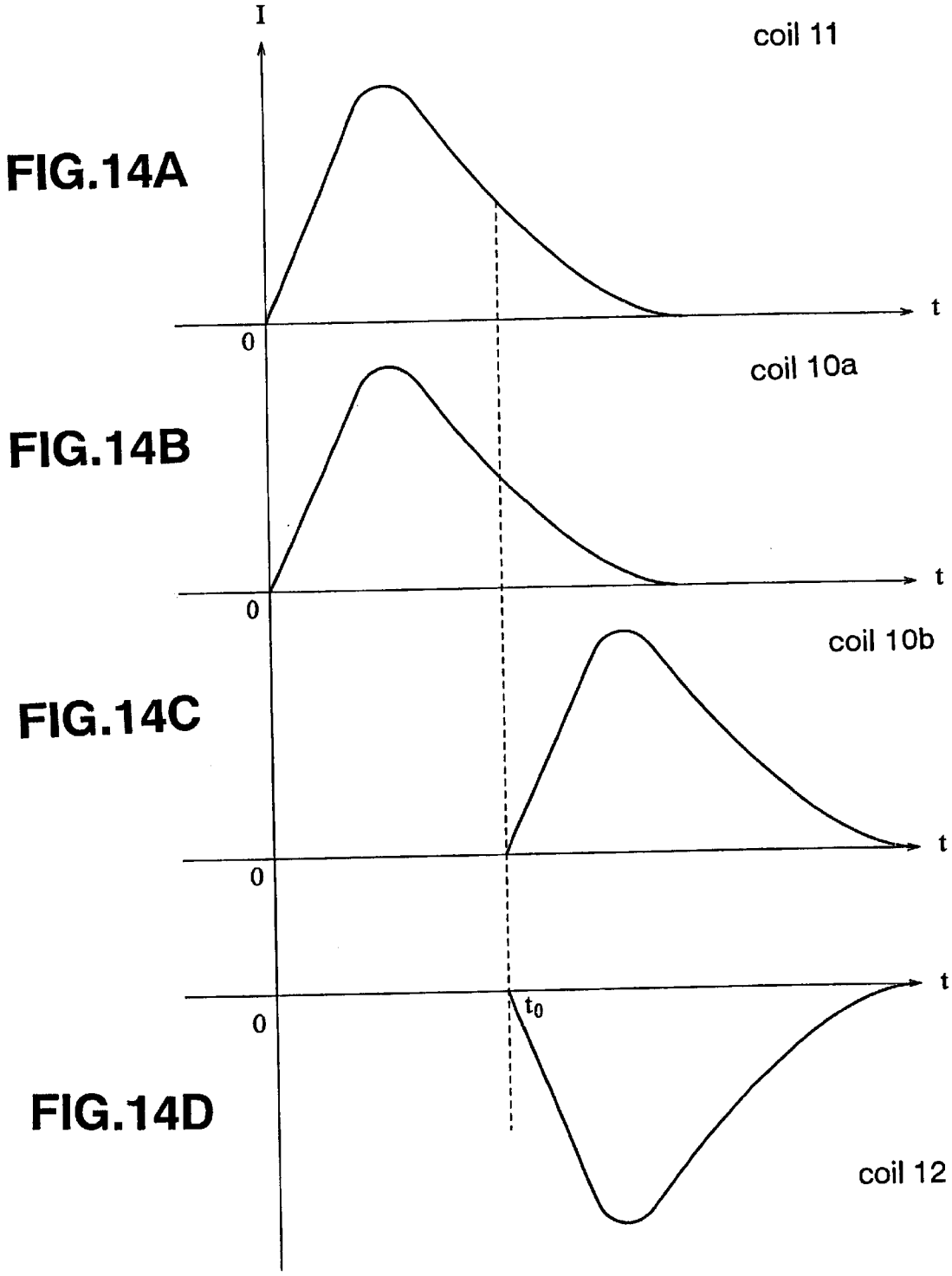
FIGS. 14A–14D are graphs showing the changes with respect to time of pulse currents flowing in each coil during contact opening of the embodiment of FIG. 11.

FIGS. 11–13 are schematic elevations of an operating mechanism 9E of a fifth embodiment of a switching apparatus according to the present invention during contact opening operation. FIG. 11 shows the direction of current flow in the coils of the operating mechanism 9E at the start of contact opening operation, FIG. 12 shows the direction of current flow in the coils after the start and before the completion of contact opening operation, and FIG. 13 shows the direction of current flow in the coils at the time of completion of contact opening operation. The structure of the operating mechanism 9E of FIGS. 11–13 is similar to that of the operating mechanism 9A of FIG. 1, but it further includes sensors A and B for sensing when the movable coils 10*a* and 10*b* are in prescribed positions. Sensor A is actuated during contact opening operation when contact opening movable coil 10*a* is separated from contact opening fixed coil 11 and contact closing movable coil 10*b* is in a position so that it does not contact closing fixed coil 12. Sensor B is actuated during contact closing operation when contact closing movable coil 10*b* is separated from contact closing movable coil 12 and contact opening movable coil 10*a* is in a position such that it does not contact the contact opening fixed coil 11. The operating mechanism 9E is controlled by a control circuit having the same structure as the control circuit 60 of FIG. 9. The contact closing switch 42*b* is turned on by the operation of sensor A, and the contact opening switch 42*a* is turned on by the operation of sensor B. FIGS. 14A–14D are graphs showing the changes with time of the current flowing in each coil during contact opening operation of this embodiment of a switching apparatus.

In order to perform contact opening operation of this embodiment, when the operating mechanism 9E is in the closed contact state shown in FIG. 11, after changeover switch 61 of FIG. 9 is moved to the position shown by dashed lines and changeover switch 62 is moved to the position shown by solid lines, if contact opening switch 42*a* is turned on, a pulse current flows in contact opening fixed coil 11 and contact opening movable coil 10*a*, and an electromagnetic repulsive force is generated which repels coils 10*a* and 11 from each other. Movable coils 10*a* and 10*b* are thereby pushed downwards from the position shown in FIG. 11. When the contact opening movable coil 10*a* reaches a predetermined position in which it is spaced from fixed coil 11 and movable coil 10*b* is spaced from fixed coil 12, sensor A is actuated and turns on contact closing switch 42*b*, and as shown in FIG. 12, a pulse current flows in contact closing fixed coil 12 and contact closing movable coil 10*b* in a direction causing them to exert an electromagnetic attractive force on each other. At this time, the electromagnetic repulsive force exerted by the contact opening coils 10*a* and 11 is decreasing, so at the completion of contact opening operating shown in FIG. 13, current is flowing only in coils 10*b* and 12, so contact opening operation is completed by the electromagnetic attractive force generated by coils 10*b* and 12.

Next, contact closing operation will be explained. After changeover switch 61 is moved to a state shown by solid lines and changeover switch 62 is moved to a state shown by dashed lines in FIG. 9, the contact opening switch 42*b* is turned on, a pulse current flows in contact closing fixed coil 12 and contact closing movable coil 10*b*, and an electromagnetic repulsive force is generated which repels coils 10*b* and 12 from each other. This force pushes movable coils 10*b* and 10*a* upwards from the position shown in FIG. 13. When contact closing movable coil 10*b* reaches a predetermined position in which it is spaced from fixed coil 12 and movable coil 10*b* is spaced from fixed coil 11, sensor B is actuated and turns on the contact opening switch 42*a*, and a pulse current flows in contact opening fixed coil 11 and contact opening movable coil 10*a*, causing coils 10*a* and 11 to exert an electromagnetic attractive force on each other. Then, the electromagnetic repulsive force exerted by the contact closing coils 10*b* and 12 decreases, and contact closing operation is completed by the electromagnetic attractive force exerted by the contact opening coils 10*a* and 11.

In this manner, control circuit 60 initially supplies current to one set of the two sets of coils to generate an electromagnetic force which acts in a direction to repel the fixed coil and the movable coil of the one set from each other, and after the movable coil of the one set has moved by a predetermined amount (as detected by sensor A or sensor B), the other coil set is made to conduct such that an electromagnetic force acts in the direction to attract the fixed coil and the movable coil of the other set to each other to complete opening or closing operation.

Accordingly, as electromagnetic force acts when coils are within the range in which they are affected by electromagnetic repulsive force or electromagnetic attractive force, electromagnetic force can be efficiently applied to the coils, and contacting opening and closing operation can be performed with certainty.

Instead of contact closing switch 42*b* and contact opening switch 42*a* being turned on by the operation of sensors A and B, they can be turned on after a certain amount of time has elapsed from the start of opening or closing operation, or they can be turned on when the current flowing in the coils decreases to a predetermined level.

Figure 15:
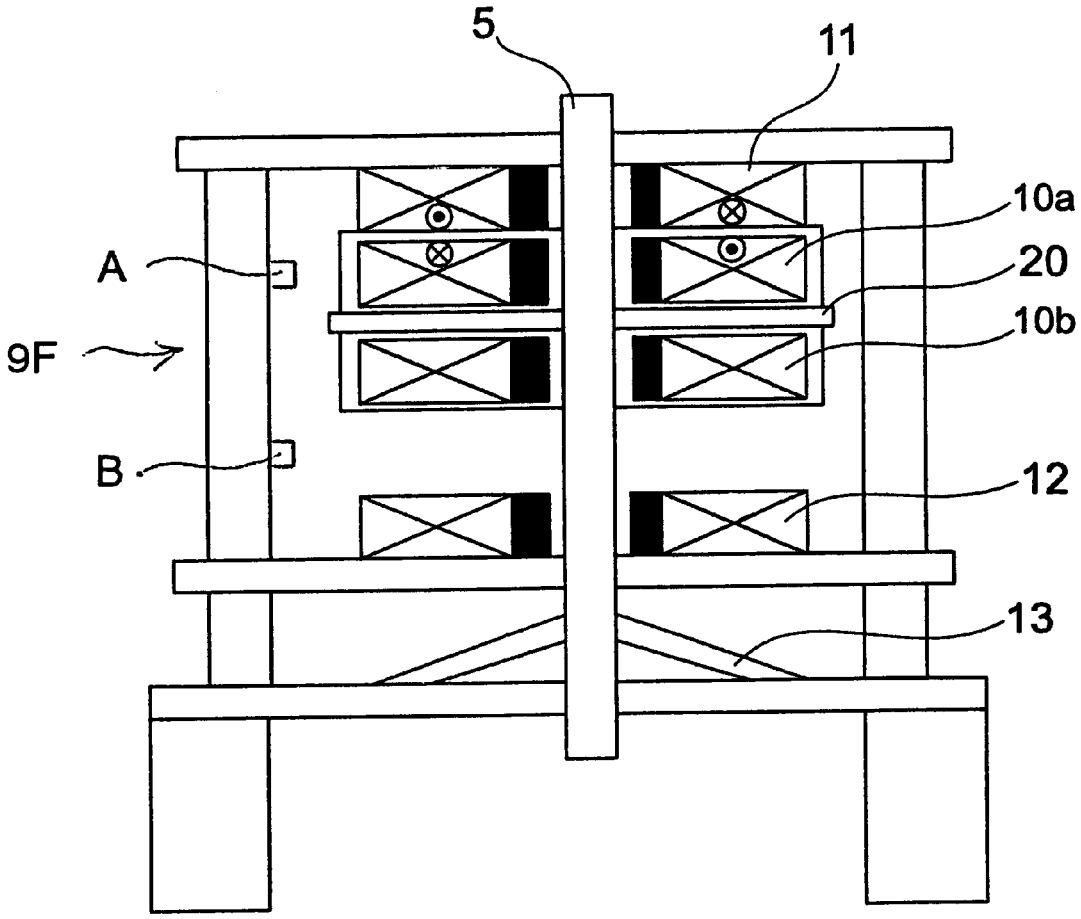
FIG. 15 is a schematic elevation of an operating mechanism of a sixth embodiment of a switching device according to the present invention showing the direction of current flowing in each coil of the operating mechanism at the start of contact opening.
Figure 16:
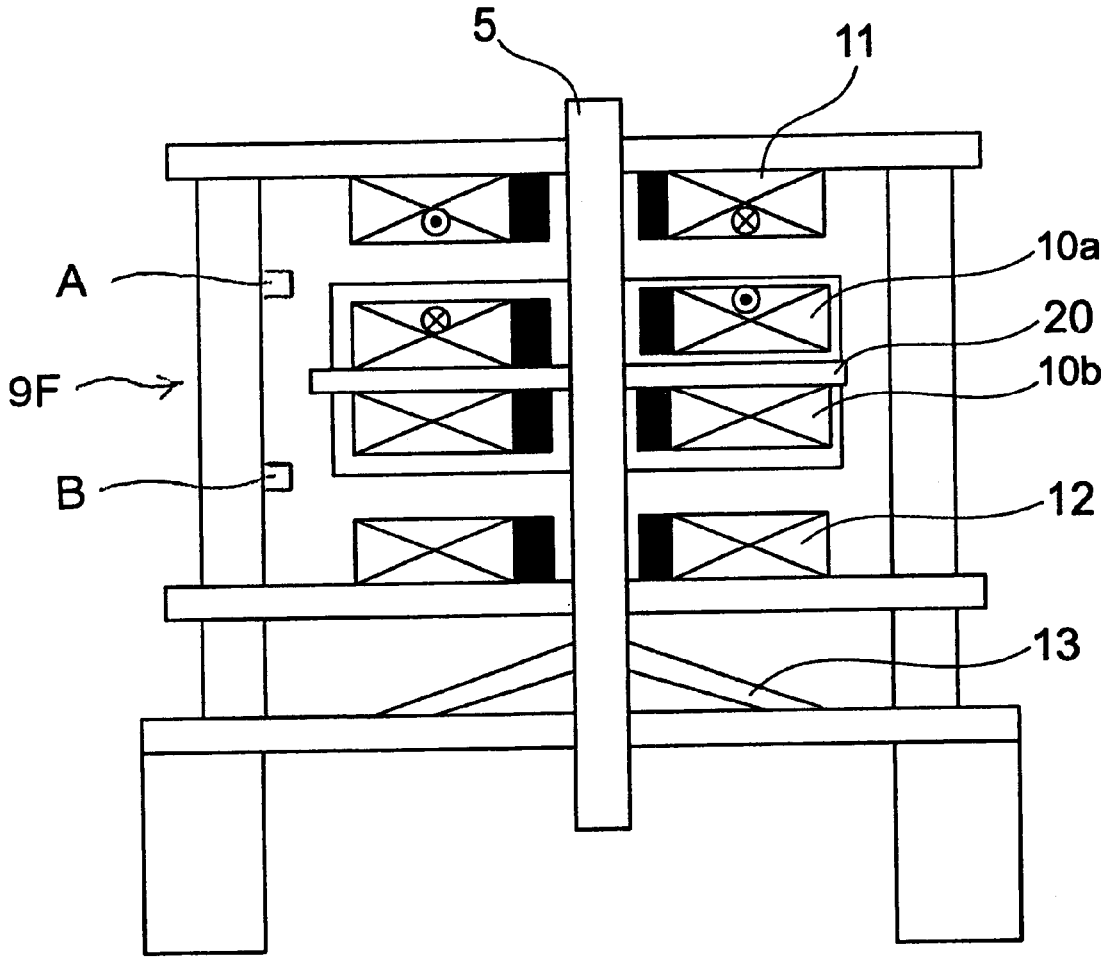
FIG. 16 is a schematic elevation of the operating mechanism of FIG. 15 showing the direction of current flow after the start of contact opening.
Figure 17:
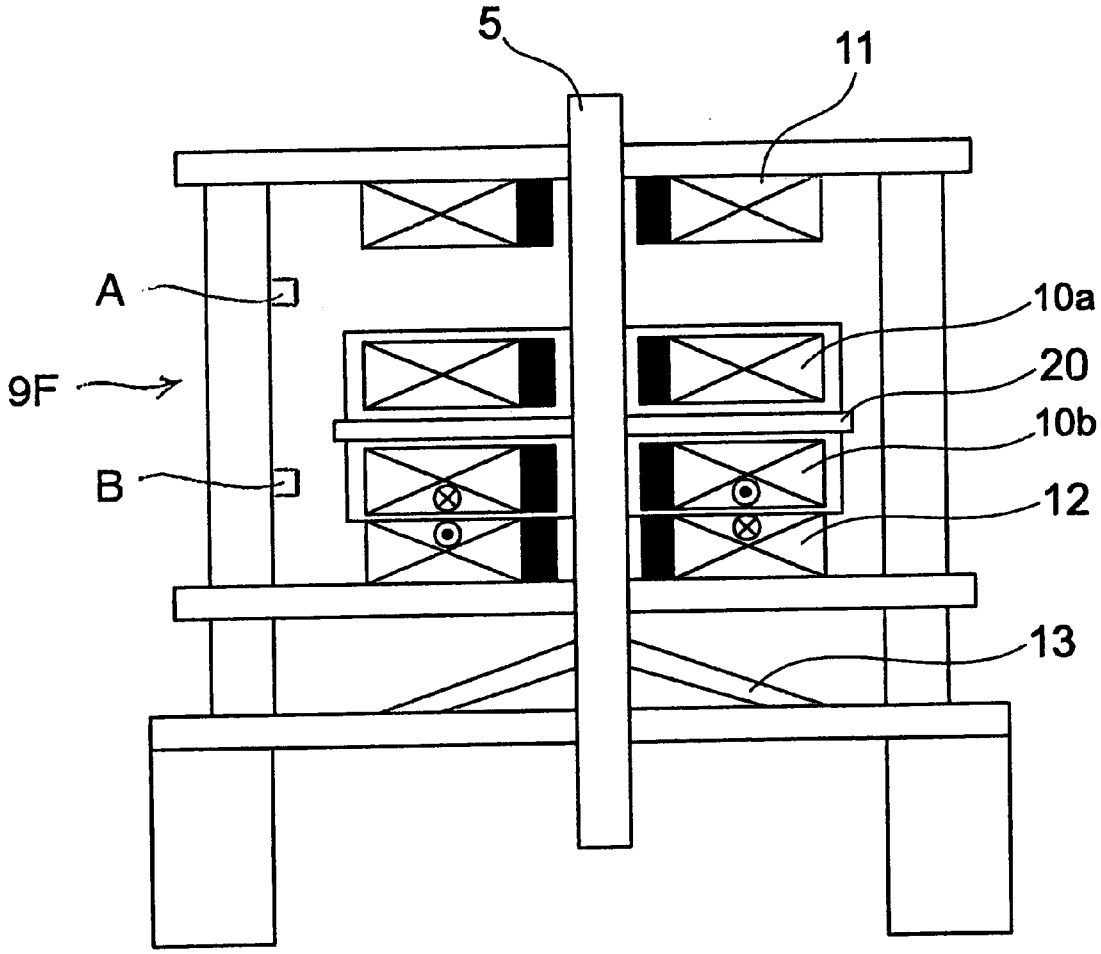
FIG. 17 is a schematic elevation of the operating mechanism of FIG. 15 showing the direction of current flow just before the completion of contact opening.

FIGS. 15–17 are schematic elevations of an operating mechanism 9F of a sixth embodiment of a switching apparatus according to the present invention, showing the direction of current flow in each coil of the operating mechanism 9F during contact opening operation. FIG. 15 shows the direction of current flow at the start of contact opening operation, FIG. 16 shows the direction of current flow after the start of contact opening operation and before the completion of operation, and FIG. 17 shows the direction of current flow just before the completion of contact opening operation. The structure of the operating mechanism 9F of this embodiment can be identical to that of the embodiment of FIG. 11, with the operating mechanism 9F being equipped with sensors A and B for sensing when the movable coils 10*a* and 10*b* are in prescribed positions during contacting opening or contacting closing operation. The operating mechanism 9F is controlled by a control circuit like control circuit 40 of FIG. 2. FIGS. 18A–18D show the changes with respect to time of pulse currents flowing in each coil during contact opening operation of the operating mechanism 9F.

Figures 18A, 18B, 18C, 18D:
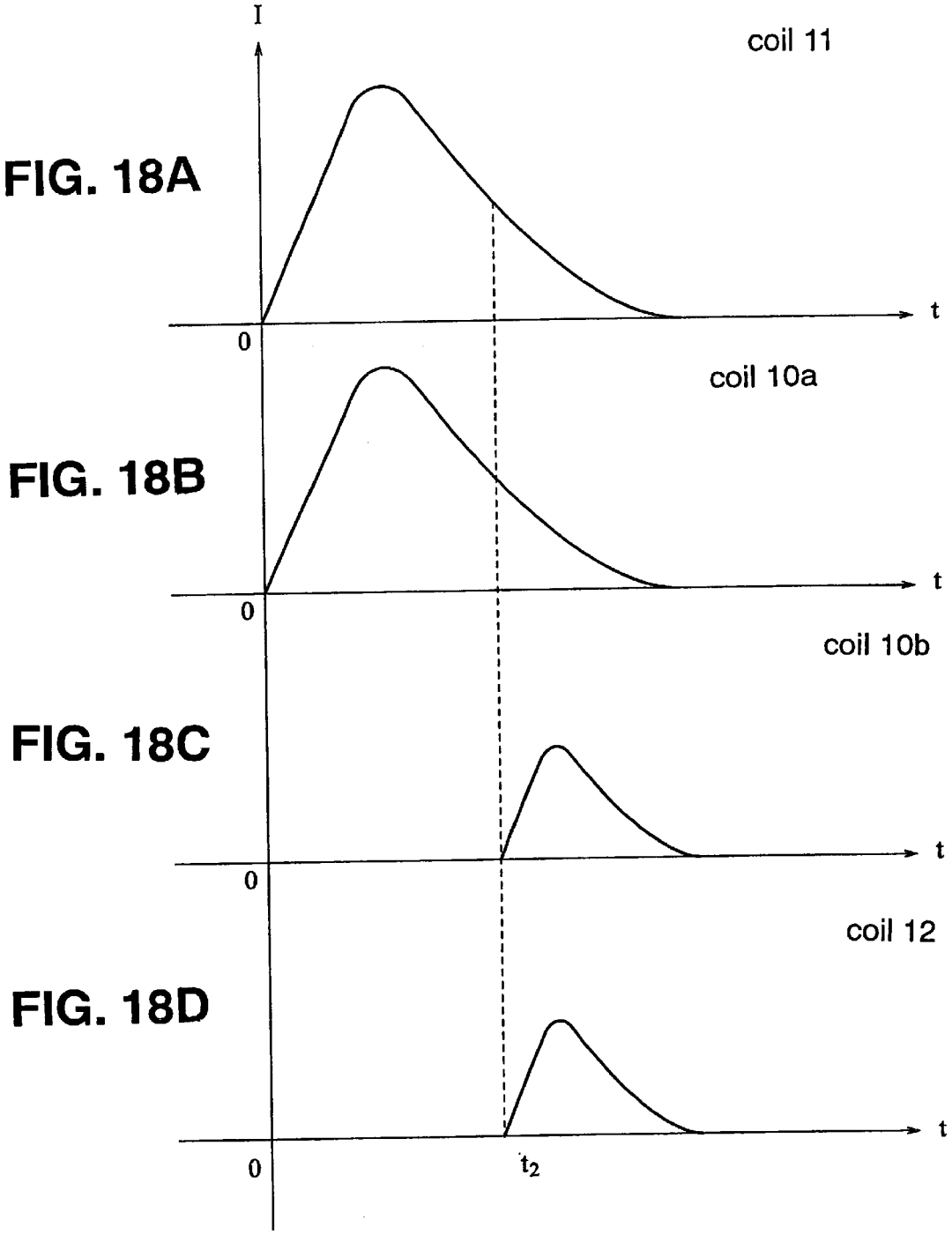
FIGS. 18A–18D are graphs showing the changes with respect to time of pulse currents flowing in each coil during contact opening of the embodiment of FIG. 15.

When the operating mechanism 9F is in the closed contact state shown in FIG. 15, if contact opening switch 42*a* is turned on, a pulse current flows in contact opening fixed coil 11 and contact opening movable coil 10*a* as shown in FIGS. 18A and 18B, and an electromagnetic repulsive force is generated which repels the two coils 10*a* and 11 from each other. Movable coils 10*a* and 10*b* are thereby pushed downwards from the position shown in FIG. 15. When movable coil 10*a* reaches a predetermined position in which it is spaced from fixed coil 11 and movable coil 10*b* is spaced from fixed coil 12, sensor A is actuated to turn on contact closing switch 42*b*. As a result, as shown in FIG. 17 and in FIGS. 18C and 18D, a pulse current flows in contact closing fixed coil 12 and contact closing movable coil 10*b*, and an electromagnetic repulsive force which repels coils 10*b* and 12 from each other is generated. This electromagnetic repulsive force acts as a brake on the movable coils 10*a* and 10*b* which are moving at high speed, so it prevents damage due to impact between coils 10*b* and 12. By decreasing the voltage which is stored in the contact closing electric power storage device 41*b*, the current which flows in coils 10*b* and 12 at this time is made smaller than the current which flowed through coils 10*a* and 11 at the start of contact opening operation, so rebounding of movable coil 10*b* due to the electromagnetic repulsive force which acts as a brake and reclosing of the contacts in the switch portion 3 can be prevented.

Contact closing operation is substantially the reverse of contact opening operation. When the operating mechanism 9F is in the closed contact state shown in FIG. 17, if contact closing switch 42*b* is turned on, a pulse current flows in coils 10*b* and 12, and an electromagnetic repulsive force is generated which repels coils 10*b* and 12 from each other. Movable coils 10*a* and 10*b* are thereby pushed upwards from the position shown in FIG. 17. When movable coil 10*b* reaches a predetermined position in which it is spaced from fixed coil 12 and movable coil 10*b* is spaced from fixed coil 11, sensor B is actuated to turn on contact opening switch 42*a*. As a result, a pulse current flows in contact opening fixed coil 11 and contact opening movable coil 10*a*, and an electromagnetic repulsive force which repels coils 10*a* and 11 from each other and acts as a brake is generated. Thus, a braking force can be generated both during contacting opening and contacting closing operation.

In this manner, the control circuit 40 of this embodiment initiates contact opening or closing operation by causing one set of coils to conduct such that an electromagnetic force acts in a direction to repel the fixed coil and the movable coil of the one set from each other, and when the movable coil of the other set approaches the fixed coil of the other set, the other set of coils is made to conduct such that an electromagnetic force acts in a direction to repel the fixed coil and the movable coil of the other set from each other to generate a braking force at the completion of contact opening or closing operation.

The pulse current supply which generates the electromagnetic repulsive force which acts as a brake can be decreased by decreasing the capacity of each of the electric power storage devices.

As in the embodiment of FIG. 15, instead of contact closing switch 42*b* and contact opening switch 42*a* being turned on by the operation of sensors A and B, they can be turned on after a certain amount of time has elapsed from the start of opening or closing operation, or they can be turned on when the current flowing in the coils decreases to a predetermined level.

Figure 19:
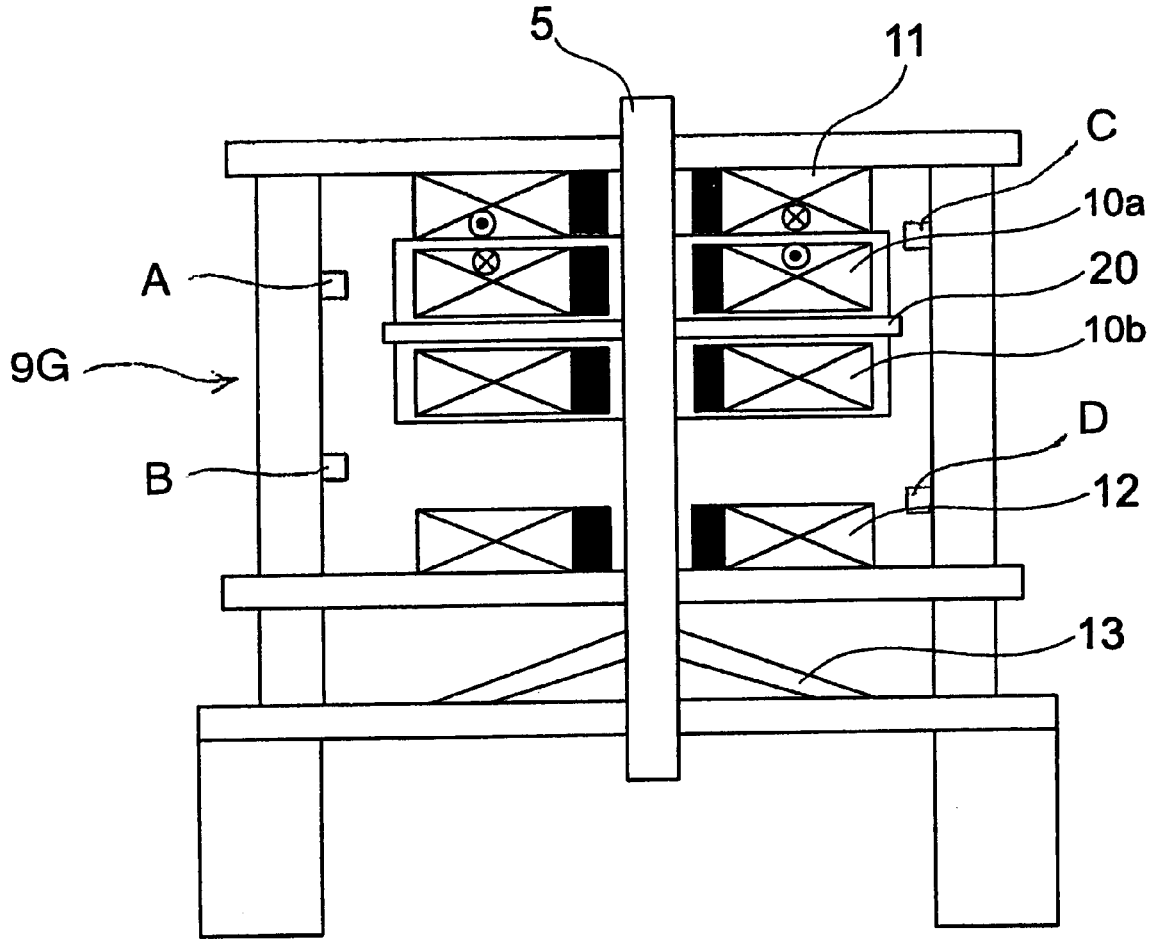
FIG. 19 is a schematic elevation of an operating mechanism of a seventh embodiment of a switching device according to the present invention showing the direction of current flowing in each coil of the operating mechanism at the start of contact opening.
Figure 20:
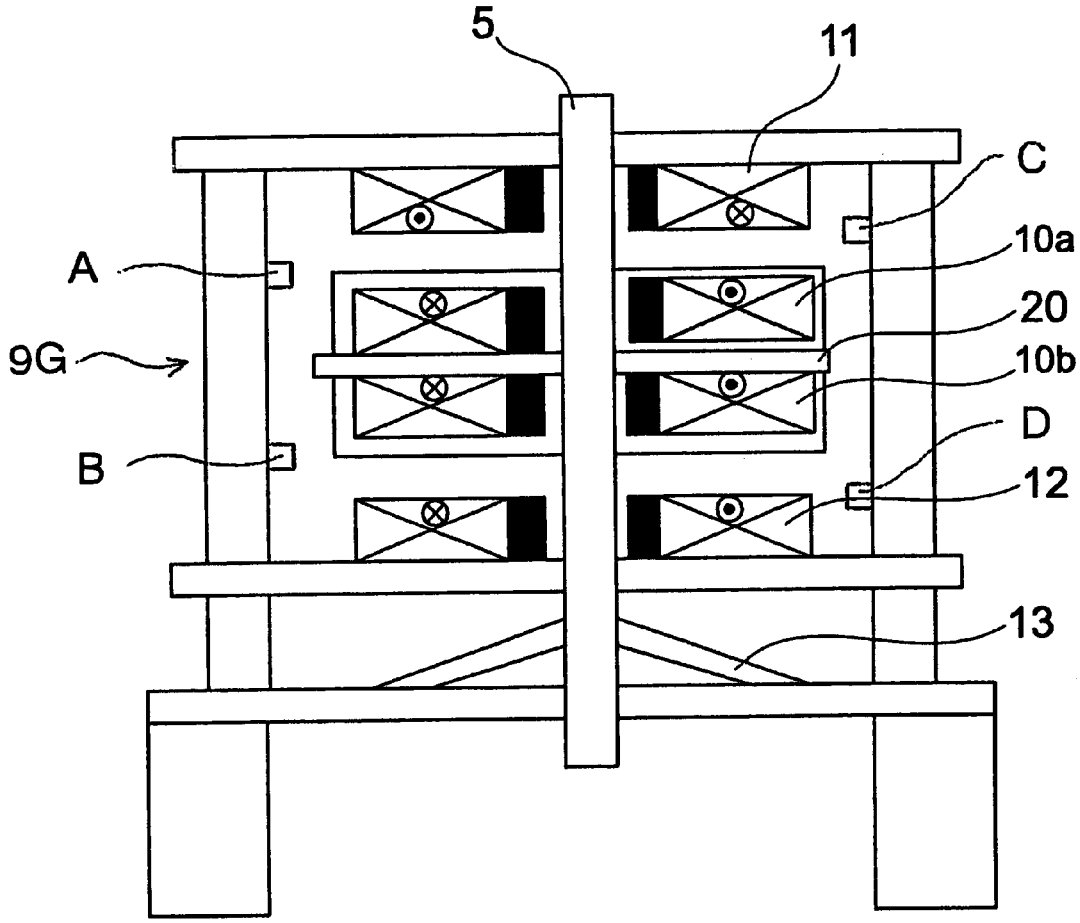
FIG. 20 is a schematic elevation of the operating mechanism of FIG. 19 showing the direction of current flow after the start of contact opening.
Figure 21:
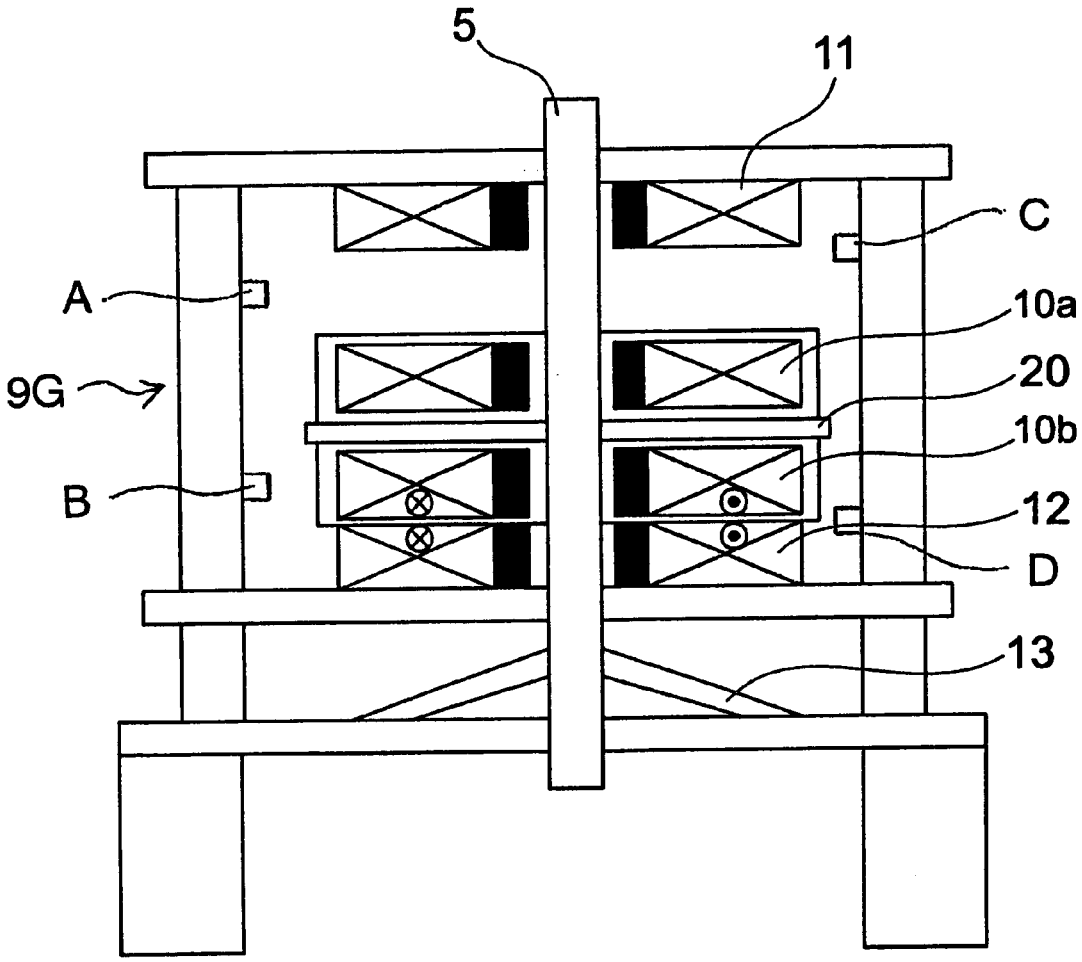
FIG. 21 is a schematic elevation of the operating mechanism of FIG. 19 showing the direction of current flow before the completion of contact opening.
Figure 22:
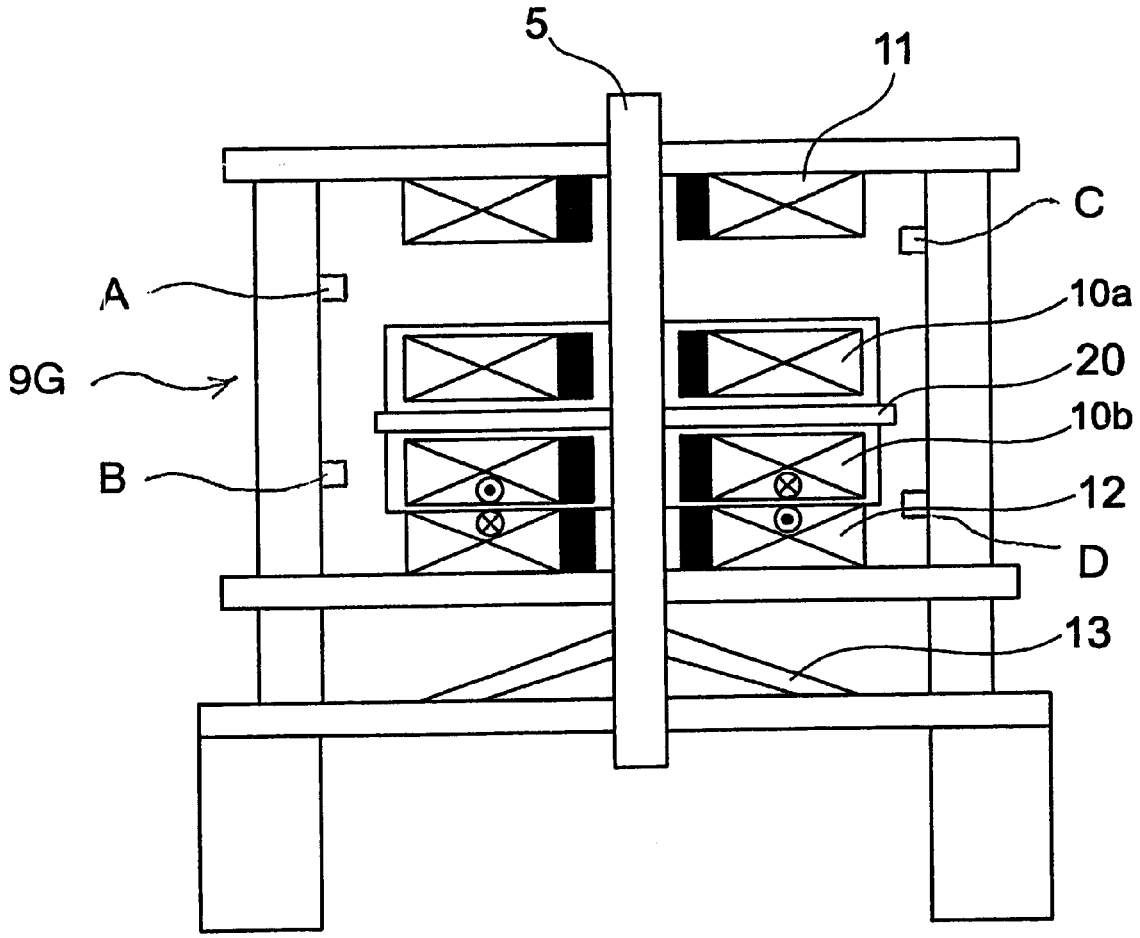
FIG. 22 is a schematic elevation of the operating mechanism of FIG. 19 showing the direction of current flow just before the completion of contact opening.
Figures 23A, 23B, 23C, 23D:
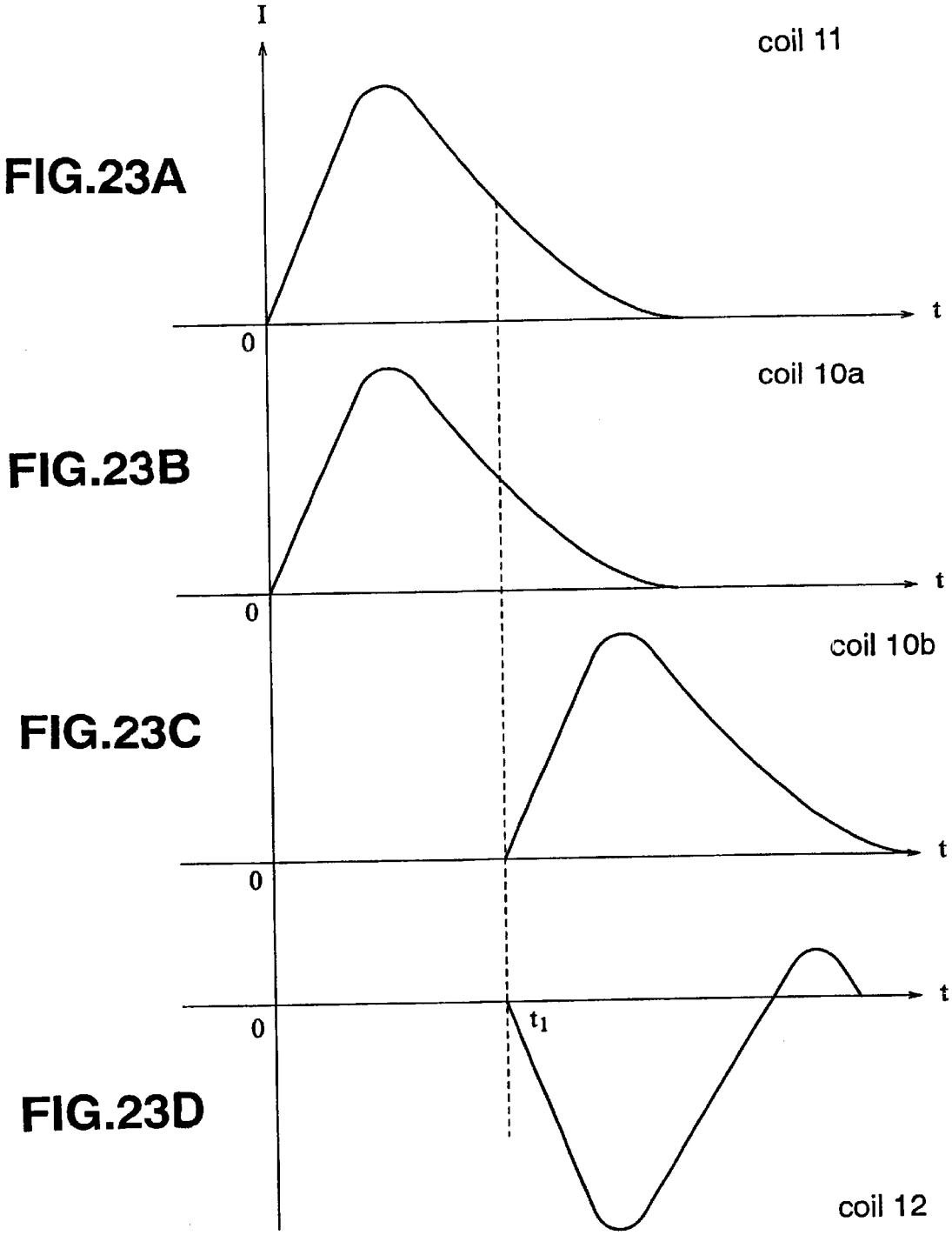
FIGS. 23A–23D are graphs showing the changes with respect to time of pulse currents flowing in each coil during contact opening of the embodiment of FIG. 19.

FIGS. 19–22 are schematic elevations of an operating mechanism 9G of a seventh embodiment of a switching apparatus according to the present invention, showing the direction of current flowing in each coil of the operating mechanism 9G during contact opening operation. FIG. 19 shows the direction of current flow at the start of contact opening operation, FIG. 20 shows the direction of current flow after the start of contact opening operation, FIG. 21 shows the direction of current flow before the completion of contact opening operation, and FIG. 22 shows the direction of current flow just before the completion of contact opening operation. FIGS. 23A–23D show the changes with respect to time of pulse currents flowing in each coil of the operating mechanism 9G during contact opening operation. The structure of the operating mechanism 9G is similar to that of the operating mechanism 9E of FIG. 11, but in addition to sensors A and B, it is equipped with sensor C, which is actuated just before the completion of contact opening operation, and sensor D, which is actuated just before the completion of contact closing operation. The operating mechanism 9G is controlled by a control circuit which has the same structure as the control circuit 60 of FIG. 9. The actuation of sensor C switches changeover switch 62 to the state shown by dashed lines in FIG. 9 just before the completion of contact opening operation, and the actuation of sensor D switches changeover switch 61 to the state shown by dashed lines just before the completion of contact closing operation.

First, contact opening operation will be explained. At the start of contact opening operation, changeover switch 61 is set to the state shown by dashed lines and changeover switch 62 is set to the state shown by solid lines in FIG. 9. When the operating mechanism 9G is in the closed contact state of FIG. 19, if contact opening switch 42*a* is turned on, a pulse current is supplied to contact opening fixed coil 11 and contact opening movable coil 10*a* in the direction shown in FIG. 19, and an electromagnetic repulsive force is generated by the coils 10*a* and 11 to repel these coils from each other. Due to this repulsive force, contact opening movable coil 10*a* is pushed downwards from the position shown in FIG. 19. When movable coil 10*a* reaches a predetermined position in which it is spaced from fixed coil 11 and movable coil 10*b* is spaced from fixed coil 12, sensor A is actuated and turns on contact closing switch 42*b*, so a pulse current is supplied to contact closing movable coil 10*b* and contact closing fixed coil 12 in the directions shown in FIG. 20. As a result, electromagnetic attractive forces are generated by contact closing fixed coil 12 and contact closing movable coil 10*b* to attract these two coils to each other. As shown in FIG. 21, this electromagnetic attractive force is generated until just before the completion of contact opening, at which point sensor C is actuated to switch changeover switch 62 to a state shown by dashed lines in FIG. 9. As a result, the direction of the current supplied to fixed coil 12 changes to that shown in FIG. 22, so that the electromagnetic force generated by coils 10*b* and 12 changes from an attractive force to a repulsive force which exerts a braking action.

Contact closing operation is the reverse of contact opening operation. At the start of contact opening operation, changeover switch 61 is set to the state shown by solid lines and changeover switch 62 is set to the state shown by dashed lines in FIG. 9. If contact closing switch 42*b* is turned on, a pulse current is supplied to contact closing fixed coil 12 and contact closing movable coil 10*b*, and electromagnetic repulsive forces are generated by the coils 10*b* and 12 to repel these coils from each other. Due to this repulsive force, contact closing movable coil 10*b* is pushed upwards from the position shown in FIG. 22. When movable coil 10*b* reaches a predetermined position in which it is spaced from fixed coil 12 and movable coil 10*a* is spaced from fixed coil 11, sensor B is actuated and turns on contact opening switch 42*a*, so current is supplied to contact opening movable coil 10*a* and contact opening fixed coil 11 to generate an electromagnetic attractive force which attracts coils 10*a* and 11 to each other. This electromagnetic attractive force is generated until just before the completion of contact closing operation, at which point sensor D is actuated to switch changeover switch 61 to a state shown by dashed lines in FIG. 9. As a result, the direction of the current supplied to fixed coil 11 is reversed so that the electromagnetic force generated by coils 10*a* and 11 changes from an attractive force to a repulsive force which provides a braking effect.

In this manner, control circuit 60 operates in this embodiment such that when a movable coil nears the opposing fixed coil at the completion of contact opening or contact closing operation, an electromagnetic attractive force generated by the two coils is changed to an electromagnetic repulsive force which provides a braking action.

Accordingly, contact opening operation and contact closing operation can be carried out by the combination of electromagnetic repulsive forces and electromagnetic attractive forces, so contact opening and closing operation can be performed at high speed with good responsiveness. Furthermore, by applying an electromagnetic repulsive force just before coils impact each other, coil impact forces are decreased, and the likelihood of coil damage due to such impact forces is decreased.

Instead of contact closing switch 42*b* and contact opening switch 42*a* being turned on by the operation of sensors A and B, they can be turned on after a certain amount of time has elapsed from the start of opening or closing operation, or they can be turned on when the current flowing in the coils decreases to a predetermined level. Similarly, changeover switches 62 and 61 may be operated after a certain amount of time has elapsed or when the current flowing in the coils decreases to a predetermined level, without the use of sensors C and D.

The embodiments shown in FIGS. 8A–22 employ operating mechanisms which are the same or similar in structure to the operating mechanism 9A of FIG. 1. These embodiments can be modified to employ other types of operating mechanisms, such as operating mechanisms like those illustrated in FIGS. 6 and 7. For example, the operating mechanisms 9B and 9C of FIGS. 6 and 7 may be equipped with sensors A–D like those employed in operating mechanisms 9E–9G, and they may be controlled in the same manner as any of operating mechanisms 9D–9G.

In the control circuit 60 of FIG. 9, changeover switches 61 and 62 are shown as being switches having contacts, but they may instead be contactless switches.

In each of the above-described embodiments of the present invention, the efficiency of the coils can be increased by providing each coil with an iron core on its inner side to concentrate magnetic flux.

As is clear from the above description, the present invention can provide benefits such as the following:

(1) In one form of the present invention, a switching apparatus includes a pair of fixed coils and a pair of movable coils, with one pair being disposed between the other pair. The coils include two sets, each set including one of the fixed coils and one of the movable coils. Due to the presence of two coil sets, the electromagnetic force generated by the coils can be effectively utilized, and a large drive force can be generated.

(2) In one preferred embodiment, the movable coils are disposed back to back on opposite sides of a support plate and are supported by the support plate between the fixed coils. With this structure, the movable coils can be reliably supported against impact forces during high speed movement thereof, the rigidity of the movable coils can be increased, and a switching apparatus of high reliability can be obtained.

(3) In another preferred embodiment, an outer frame is connected to a movable shaft and a support plate supported by the outer frame, and the movable coils are disposed back to back on opposite sides of the support plate and are supported by the support plate between the fixed coils. With this structure, the movable coils can be supported over a large surface area to enable impact forces to be evenly distributed, and the rigidity of the movable coils can be increased.

(4) In yet another preferred embodiment, the fixed coils are disposed back to back on opposite sides of a support plate and are supported by the support plate between the movable coils, and the movable coils are connected to a movable shaft. With such a structure, a reinforcing material can be provided on the surfaces of the movable coils facing away from the fixed coils, so the rigidity of the movable coils can be increased while maintaining a desired separation between the centers of coils and without decreasing the electromagnetic force generated by the coils.

(5) In one form of the present invention, a controller supplies current to one of the two sets of coils but not to the other set of coils to repel the two coils of the one set from each other to open a switch portion, and it supplies current to the other set of coils but not to the one set of coils to repel the two coils of the other set from each other to close the switch portion. As a result, opening and closing operation can be performed with a good response speed.

(6) In another form of the present invention, during contact opening or closing operation, a controller supplies current to one of the two sets of coils to repel the two coils of the one set from each other and simultaneously supplies current to the other set of coils to attract the two coils of the other set to each other. As a result, the electromagnetic forces generated by both sets of coils can be simultaneously utilized, so the response speed improves, and contacting opening and closing operation can be performed with certainty.

(7) In still another form of the present invention, during contact opening or closing operation, a controller supplies current to one of the two sets of coils to repel the two coils of the one set from each other and subsequently supplies current to the other set of coils to attract the two coils of the other set to each other. Therefore, each set of coils can generate an electromagnetic force at a time when the force is most effective, so contact opening and closing can be performed efficiently and with certainty.

(8) In yet another form of the present invention, a controller supplies current to one of the two sets of coils prior to contact between the two coils of the set to repel the two coils from each other and generate a braking force. As a result, impact forces acting on the coils at the time of contact between opposing coils can be decreased, and damage to the movable coils can be prevented.

What is claimed is:

1. A switching device comprising:

a switch portion having a fixed electrode and a movable electrode which is movable with respect to the fixed electrode between an open position and a closed position to open and close the switch portion;

a movable shaft which extends from the movable electrode;

an operating mechanism having a pair of fixed coils and a pair of movable coils, the movable coils being operatively connected to the movable shaft for translating the movable shaft in an axial direction, one of the pairs of coils being disposed between the other pair of coils; and a controller which controls supply of current to the coils of the operating mechanism.

2. The switching apparatus as claimed in claim 1, wherein the operating mechanism includes a support plate connected to the movable shaft, and the movable coils are disposed back to back on opposite sides of the support plate and are supported by the support plate between the fixed coils.

3. The switching apparatus as claimed in claim 1, wherein the operating mechanism includes an outer frame connected to the movable shaft and a support plate supported at a periphery by the outer frame, and the movable coils are disposed back to back on opposite sides of the support plate and are supported by the support plate between the fixed coils.

4. The switching apparatus as claimed in claim 1, wherein the operating mechanism includes a support plate, the fixed coils are disposed back to back on opposite sides of the support plate and are supported by the support plate between the movable coils, and the movable coils are connected to the movable shaft.

5. The switching apparatus as claimed in claim 1, wherein:

the coils of the operating mechanism comprise a first set of coils comprising one of the fixed coils and one of the movable coils, and a second set of coils comprising the other of the fixed coils and the other of the movable coils; and during opening of the switch portion, the controller supplies current to one of the first and second sets of coils but not to the other of the first and second sets of coils to repulse the two coils of the one set from each other to open the switch portion, and during closing of the switch portion, the controller supplies current to the one set of coils but not to the other set of coils to repulse the two coils of the other set from each other to close the switch portion.

6. The switching apparatus as claimed in claim 1, wherein:

the coils of the operating mechanism comprise a first set of coils comprising one of the fixed coils and one of the movable coils, and a second set of coils comprising the other of the fixed coils and the other of the movable coils; and during opening or closing of the switch portion, the controller supplies current to one of the first and second sets of coils to repulse the two coils of the one set from each other and, simultaneously, supplies current to the other of the first and second sets of coils to attract the two coils of the other set to each other.

7. The switching apparatus as claimed in claim 1, wherein:

the coils of the operating mechanism comprise a first set of coils comprising one of the fixed coils and one of the movable coils, and a second set of coils comprising the other of the fixed coils and the other of the movable coils; and during opening or closing of the switch portion, the controller supplies current to one of the first and second sets of coils to repulse the two coils of the one set from each other and subsequently supplies current to the other of the first and second sets of coils to attract the two coils of the other set to each other.

8. The switching apparatus as claimed in claim 1, wherein:

the coils of the operating mechanism comprise a first set of coils comprising one of the fixed coils and one of the movable coils, and a second set of coils comprising the other of the fixed coils and the other of the movable coils; and during opening or closing of the switch portion, the controller supplies current to one of the first and second sets of coils to repulse the two coils of the one set from each other and supplies current to the other set of coils to repulse the two coils of the other of the first and second sets from each other to produce a braking action just before the two coils of the other set contact each other.

* * * * *